US010779097B2

(12) United States Patent
Taylor et al.

(10) Patent No.: US 10,779,097 B2
(45) Date of Patent: Sep. 15, 2020

(54) AUDIO CONNECTOR AND CIRCUITRY

(71) Applicant: Cirrus Logic International Semiconductor Ltd., Edinburgh (GB)

(72) Inventors: Jonathan Taylor, London (GB); ChunFeng Gu, Shanghai (CN)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 16/380,740

(22) Filed: Apr. 10, 2019

(65) Prior Publication Data

US 2019/0246226 A1 Aug. 8, 2019

Related U.S. Application Data

(63) Continuation of application No. 15/918,829, filed on Mar. 12, 2018, now Pat. No. 10,306,387, which is a (Continued)

(51) Int. Cl.
*H04R 29/00* (2006.01)
*H04R 1/10* (2006.01)

(Continued)

(52) U.S. Cl.
CPC ..... *H04R 29/001* (2013.01); *H01R 24/58* (2013.01); *H04R 3/00* (2013.01); *H04R 3/12* (2013.01);

(Continued)

(58) Field of Classification Search
CPC ..... H04R 29/001; H04R 3/00; H04R 3/12; H04R 5/04; H04R 1/1041; H04R 2420/03;

(Continued)

(56) References Cited

U.S. PATENT DOCUMENTS 7,241,179 B2 7/2007 Chennakeshu
9,955,272 B2 * 4/2018 Taylor ..... H04R 3/00

(Continued)

FOREIGN PATENT DOCUMENTS

CN 103096216 A 5/2013
GB 2513629 A 5/2014
JP 2009278564 A 11/2009

OTHER PUBLICATIONS

International Search Report and Written Opinion, International Application No. PCT/CN2015/080823, dated Feb. 24, 2016, 15 pages.

(Continued)

*Primary Examiner* — Andrew L Sniezek
(74) *Attorney, Agent, or Firm* — Jackson Walker L.L.P.

(57) ABSTRACT

A device (10) for connection to an audio accessory (20) comprising: a jack socket (14) for connection to a jack plug (25) of the audio accessory (20), a ground connection to a first socket contact (428) which is positioned to mate with a ground return pole of the plug (25). The jack socket (14) comprises a second contact (432) also positioned to mate with the ground return pole of the plug (25). Driver amplifiers (416, 418) comprise an input coupled to the second contact (432) and are configured to superimpose a signal present at the second contact (432) onto received speaker signal. It may achieve reducing the crosstalk which could distort or blur the stereo image.

20 Claims, 19 Drawing Sheets

Related U.S. Application Data continuation of application No. 15/108,442, filed as application No. PCT/CN2015/080823 on Jun. 4, 2015, now Pat. No. 9,955,272.

(51) Int. Cl.

| | |
|---|---|
| ***H04R 3/00*** | (2006.01) |
| ***H04R 5/04*** | (2006.01) |
| ***H01R 24/58*** | (2011.01) |
| ***H04R 3/12*** | (2006.01) |
| *H01R 107/00* | (2006.01) |

(52) U.S. Cl.

CPC ..... *H04R 5/04* (2013.01); *H01R 2107/00* (2013.01); *H04R 1/1041* (2013.01); *H04R 2420/03* (2013.01); *H04R 2420/05* (2013.01); *H04R 2420/09* (2013.01)

(58) Field of Classification Search

CPC ..... H04R 2420/05; H04R 2420/09; H01R 24/58; H01R 2107/00

See application file for complete search history.

(56) References Cited

U.S. PATENT DOCUMENTS

| | | | | |
|---|---|---|---|---|
| 10,306,387 | B2 * | 5/2019 | Taylor | H04R 5/04 |
| 2012/0294454 | A1 | 11/2012 | Sakamoto et al. | |
| 2013/0089216 | A1 | 4/2013 | Han | |
| 2014/0064512 | A1 | 3/2014 | Yu et al. | |
| 2014/0244867 | A1 | 8/2014 | Li | |
| 2015/0098579 | A1 | 4/2015 | Holzmann | |
| 2015/0244116 | A1 | 8/2015 | Los | |

OTHER PUBLICATIONS https://en.wikipedia.org/wiki/USB-C (second table "Full-featured USB 31 and 2.0 Type-C cable wiring", pins 14-15 and 6-9), retrieved Nov. 8, 2018.

https://www.embedded.com/design/power-optimization/4458380/USB-Type-C-and-power-delivery-101—Ports-and- connections (Figure 3 and Table 1), retrieved Nov. 8, 2018.

* cited by examiner

AUDIO CONNECTOR AND CIRCUITRY

The present application is a continuation of U.S. patent application Ser. No. 15/918,829, filed Mar. 12, 2018, now U.S. Pat. No. 10,306,387 issued May 28, 2019, which is a continuation of U.S. patent application Ser. No. 15/108,442, filed Jun. 27, 2016, now U.S. Pat. No. 9,955,272 issued Apr. 24, 2018, which is a 35 U.S.C. 371(c) National Stage Application of International Application No. PCT/CN2015/080823, filed on Jun. 4, 2015, each of which is incorporated herein by reference in its entirety.

This invention relates to a connector, e.g. a jack socket, for receiving a plug, and more specifically to a host device that includes such a connector, allowing an audio accessory device that has a suitable plug to be connected to the host device.

BACKGROUND

Many devices having audio outputs and/or inputs, such as mobile phones, tablets, computers and the like, are provided with a socket, allowing an audio accessory device with a suitable plug, such as a headset, to be connected to the device.

FIG. 1 illustrates an audio system, in which an audio accessory 20, specifically a headset, is connected to a host device by means of a jack plug 25. The host device comprises circuitry 11, which connects to a number of contacts 26 in a jack socket. FIG. 1 shows the situation in which the jack plug 25 is inserted into the jack socket, so that poles on the jack plug 25 make electrical contact with the contacts 26.

FIG. 1 shows left and right driver amplifiers 102 and 104 driven from respective signal sources VinL and VinR. The signal sources VinL and VinR may for example comprise digital-to-analog converters (DACs) driven by received digital audio signals. These driver amplifiers 102, 104 are coupled to respective jack poles L and R by respective jack socket contacts. Signals from the driver amplifiers 102, 104 are then passed to left and right speakers respectively in the headset 20.

FIG. 1 also shows an amplifier 106 serving as a microphone pre-amplifier coupled to a microphone pole, i.e. pole M, of the jack plug via a respective contact. The amplifier 106 thus receives a signal from a microphone in the headset 20.

The pole G of the jack plug 25 provides a common ground return path for the signal paths through the other three poles L, R & M.

In this example, the plug and socket arrangement is illustrated as being a 3.5 mm 4-Pole TRRS (Tip/Ring/Ring/Sleeve) jack plug and jack socket arrangement. The small size of such a socket allows only a small area of physical, and hence electrical, contact between the jack contact within the socket and the cylindrical pole of the inserted plug. Thus there may be an appreciable contact resistance between one or more respective jack contacts and respective poles, which may be further degraded due to corrosion or foreign matter.

FIG. 1 also illustrates that there may be various parasitic resistances, including a jack contact resistance, in the ground path between the ground jack pole G, i.e. node X4, and a ground reference point X3 close to the circuitry 11. These various parasitic resistances are illustrated as lumped together into a single resistance element $R_G$. There may also be similar parasitic resistances between the microphone pole M of the jack plug and the microphone pre-amplifier 106 via the respective jack socket contact, and FIG. 1 shows these parasitic resistances lumped similarly into a single resistance element $R_M$.

The input signals VinL and VinR of the driver amplifier circuitry 102, 104 and the resulting buffered outputs VoutL and VoutR may be referenced to some ground point X1 local to the driver amplifier circuitry 102, 104. The microphone pre-amplifier 106 may be explicitly or implicitly referenced to a ground point X2 local to the pre-amplifier 106. By careful design of local ground planes or ground tracks on PCBs and/or in integrated circuits, these grounds may be maintained close in voltage to a common ground reference point, say the ground pin of an integrated circuit implementation of the circuitry 11, which in turn may be closely coupled to some local ground reference point X3. However, the voltage signals VoutL and VoutR applied to the left and right speakers may give rise to corresponding ground return currents passing through the jack contact resistance and PCB trace resistance illustrated by $R_G$, so it is likely that the ground voltage on the pole of the jack, node X4, will be significantly different from that at X3 and will also be modulated by a.c. signal components of these ground return currents corresponding to the a.c. signal components of the applied voltages VoutL and VoutR.

FIG. 2 is a more detailed electrical circuit diagram showing the system of FIG. 1.

Thus, FIG. 2 shows the left speaker 108, the right speaker 110, and the microphone 112 of the headset 20.

The current $I_G$ through the ground pole G of the jack plug comprises both the currents $I_{SL}$ and $I_{SR}$ through the left and right speakers 108, 110. Thus, ignoring any ground return current corresponding to current through the microphone pole, i.e., M pole, of the plug:

$$I_G = I_{SL} + I_{SR}.$$

Given that the resistance $R_G$ is non-negligible, the ground voltage on the ground pole, i.e. G pole, of the jack, at node X4, will differ from that at X3 by a voltage $V_{RG}$, where:

$$V_{RG} = I_G * R_G.$$

The input voltage $V_{micA}$ to the microphone amplifier 106 will not be identical to the voltage $V_{mic}$ generated by the microphone 112, but will be modulated by the voltage $V_{RG}$ as it varies with the variation of the total current $I_G$ flowing through the left and right speakers 108, 110 into the ground return path. Thus there will be crosstalk of the electrical speaker signal into the sensitive microphone channel (which is especially relevant because a typical microphone signal might be only of the order of 10 mV). That is:

$$V_{micB} = V_{micA} = V_{mic} + V_{RG}.$$

Also the respective voltages actually appearing across each respective speaker will be reduced by $V_{RG}$. That is:

$$V_{SL} = V\text{out}L - V_{RG} \text{ and}$$

$$V_{SR} = V\text{out}R - V_{RG}$$

Since $V_{RG}$ is dependent on both $I_{SR}$ and $I_{SL}$, one effect is that the respective currents through each respective speaker influence the voltage that is generated across the other speaker, and so there is crosstalk from the right channel to the left channel, and from the left channel to the right channel, which can distort or blur the stereo image.

The ground return path via resistance $R_G$ will also carry ground return current from any current taken through microphone pole M of the jack plug, and any modulation of this current may appear as audible crosstalk in the speaker outputs. The current through microphone pole M may comprise supply current for the microphone 112 which may vary with the microphone signal and possibly also if the microphone 112 is turned on or off or passes through different microphone operating modes, possibly autonomously due to some internal voice activity detector or suchlike.

Also in some applications current on this microphone supply line is used to signal to the host device, for example via one or more pushbutton switches coupled between the microphone pole M and ground pole G either directly or via resistances, illustrated by resistance Rpb 113. Use of the one or more pushbutton switches may give rise to significant step changes in the current through poles M and G, which may in turn give audible artefacts through modulating $V_{RG}$.

SUMMARY

According to an aspect of the present invention, there is provided a device for connection to an audio accessory comprising:

(a) a jack socket for connection to a jack plug of the audio accessory, wherein the jack socket comprises:

(i) first and second contacts, positioned to mate with a first pole of the jack plug, wherein one of the first and second contacts is coupled to ground, (ii) a third contact positioned to mate with a second pole of the jack plug, and (iii) a fourth contact, positioned to mate with a third pole of the jack plug, (b) a first audio driver amplifier, comprising:

(i) a first input coupled to receive a first driver signal, (ii) a second input coupled to an other of the first and second contacts, and (iii) an output coupled to said third contact, and (c) a second audio driver amplifier, comprising:

(i) a first input coupled to receive a second driver signal, (ii) a second input coupled to the other of the first and second contacts, and (iii) an output coupled to said fourth contact.

According to another aspect of the present invention, there is provided a device for connection to an audio accessory comprising:

(a) a jack socket for connection to a jack plug of the audio accessory, wherein the jack socket comprises, (i) first and second contacts, positioned to mate with a first pole of the jack plug, wherein one of the first and second contacts is coupled to ground, (ii) a third contact positioned to mate with a second pole of the jack plug, and (iii) a fourth contact, positioned to mate with a third pole of the jack plug, (b) a first audio driver amplifier, comprising:

(i) a first input coupled to receive a first driver signal;

(ii) a second input coupled to an other of said first and second contacts, and (iii) an output coupled to said third contact, and (c) a microphone pre-amplifier comprising:

(i) a first input coupled to said fourth contact, (ii) a second input coupled to the other of the first and second contacts, and (iii) an output coupled to output an amplified signal to a terminal of the device.

According to another aspect of the present invention, there is provided a first device for connection to a second device, comprising:

(a) a first device connector for connection to a connector of the second device, wherein the first device connector comprises, (i) a first contact, coupled to ground, positioned to mate with a first pole of the connector of the second device, (ii) a second contact positioned to mate with the first pole of the connector of the second device, (iii) a third contact positioned to mate with a second pole of the connector of the second device, and (iv) a fourth contact, positioned to mate with a third pole of the connector of the second device, (b) a first amplifier wherein, (i) a first input of the first amplifier is coupled to the second contact of the first device connector, (ii) a second input of the first amplifier is coupled to receive a driver signal, and (iii) an output of the first amplifier is coupled to the third contact of the first device connector, and (c) a second amplifier wherein, (i) a first input of the second amplifier is coupled to the second contact, (ii) a first port of the second amplifier is coupled to the fourth contact of first device connector, and (iii) a second port of the second amplifier is coupled to a terminal of the device.

DETAILED DESCRIPTION

Figure 1:
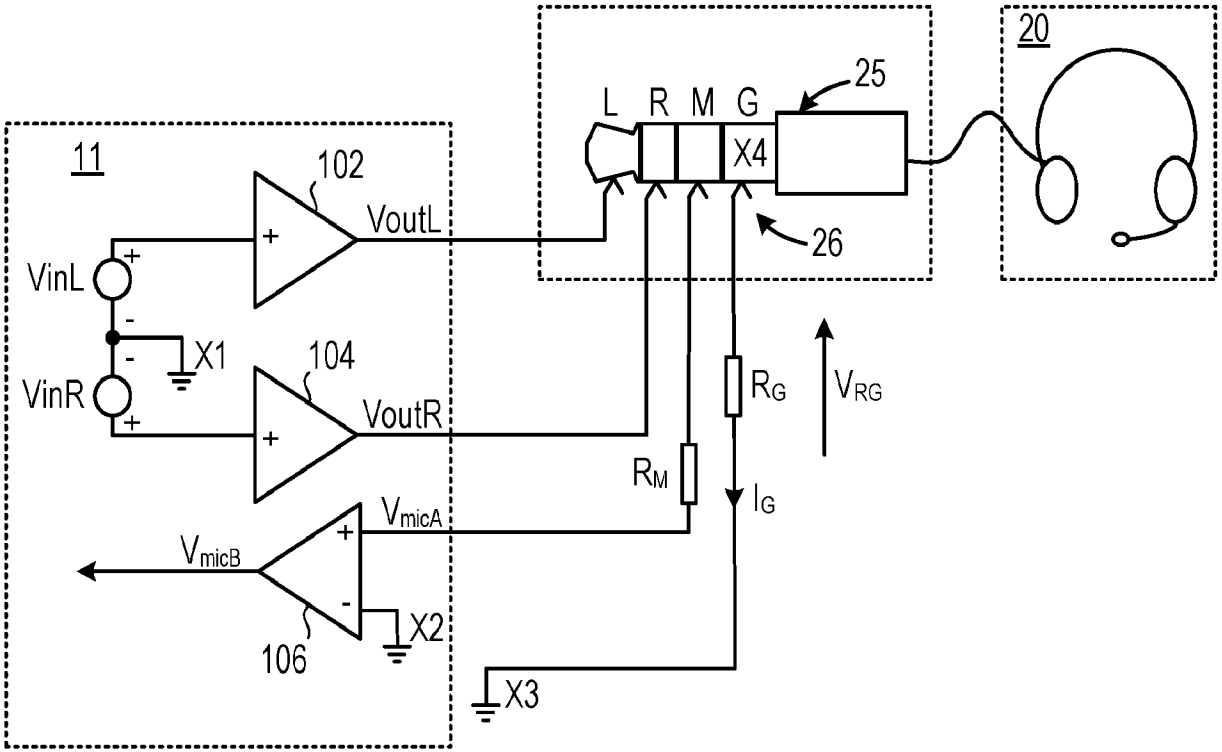
FIG. 1 is a circuit diagram of an audio system.
Figure 2:
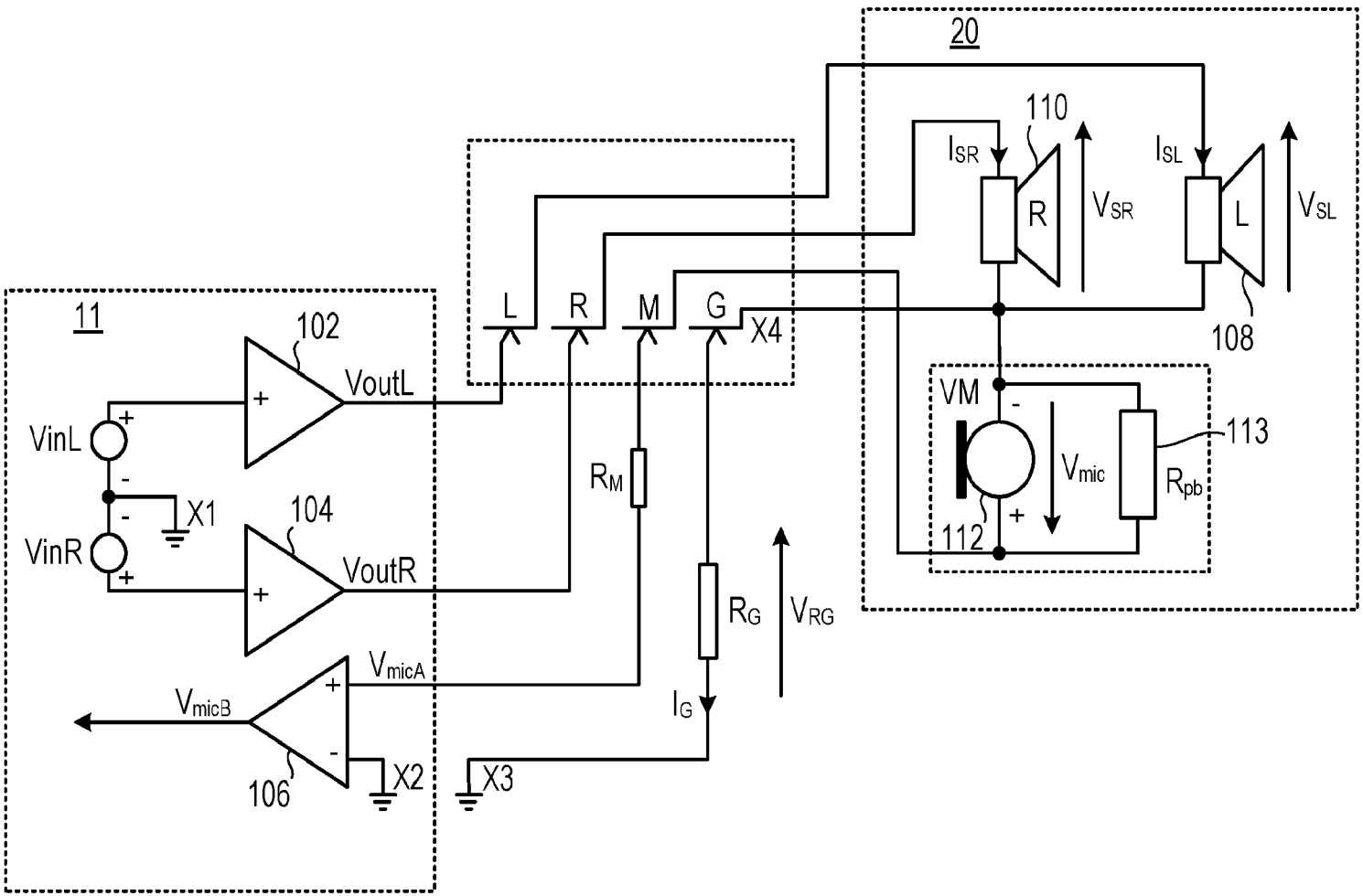
FIG. 2 is a more detailed circuit diagram of the system of FIG. 1.
Figure 3:
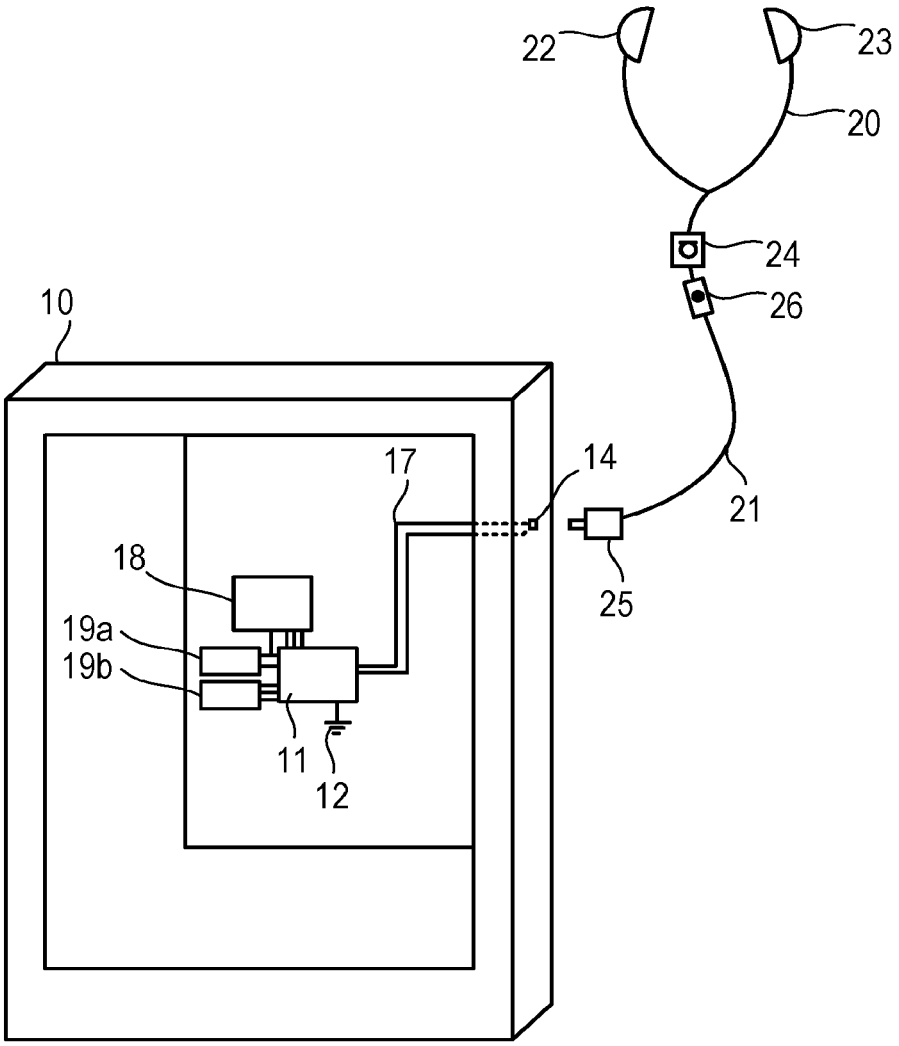
FIG. 3 illustrates an audio system.

FIG. 3 illustrates a host device 10, which may take the form of a mobile phone or tablet computer or suchlike, provided with a socket 14 into which a plug 25 may be attached. In this case, the plug 25 is provided on a cable 21 that forms part of an audio accessory 20. The audio accessory 20 is in the form of a headset, which comprises a pair of stereo speakers 22, 23, a voice microphone 24 and a push-button module 26. In this illustrated embodiment, plug 25 may be a jack plug, for instance a standard 3.5 mm diameter multi-pole audio jack plug, and socket 14 may be a compatible jack socket, but other forms of multi-pole connector may alternatively be implemented.

The host device 10 comprises circuitry 11 which may communicate with an attached accessory 20 via multiple wires 17 (which may be printed circuit board (PCB) tracks, or cables with conductors soldered on to a PCB or connected via edge connectors or suchlike) and via the socket 14. The circuitry 11 may comprise driver amplifiers for driving the headset speakers 22, 23 and a microphone preamplifier for amplifying an analogue signal received from microphone 24. Circuitry 11 may also comprise other analog or digital functions and may be an integrated circuit in the form of an audio codec and may be coupled to other circuitry 18, 19*a* and 19*b*, for instance an applications processor or a Bluetooth modem or communications processor or suchlike. The location of circuitry 11 will be governed by many constraints, for example it may be preferable to situate circuitry 11 in close proximity to other circuitry 18 and 19*a* and 19*b* to reduce the length of the many connections between these circuits, possibly carrying high-speed digital signals, for instance three digital audio bus connections to or from an integrated circuit audio codec embodiment of circuitry 11 to or from an applications processor, an r.f. modem and a communications processor, in which case the circuitry 11 might not be located adjacent to the jack socket 14. A PCB is likely to be tightly packed, and thus wires 17 that are in the form of PCB tracks 17 may be minimum or near minimum width. Thus there may be appreciable parasitic resistance of the metal tracks 17. In some cases this resistance may even be desirable, or may comprise the impedance of added components, to help protect the circuitry 11 from ESD (Electro-Static Discharge) events occurring at the external jack socket or to help filter high frequency EMI (Electromagnetic Interference).

The circuitry 11 may be provided with a star ground reference point 12.

Figure 4A:
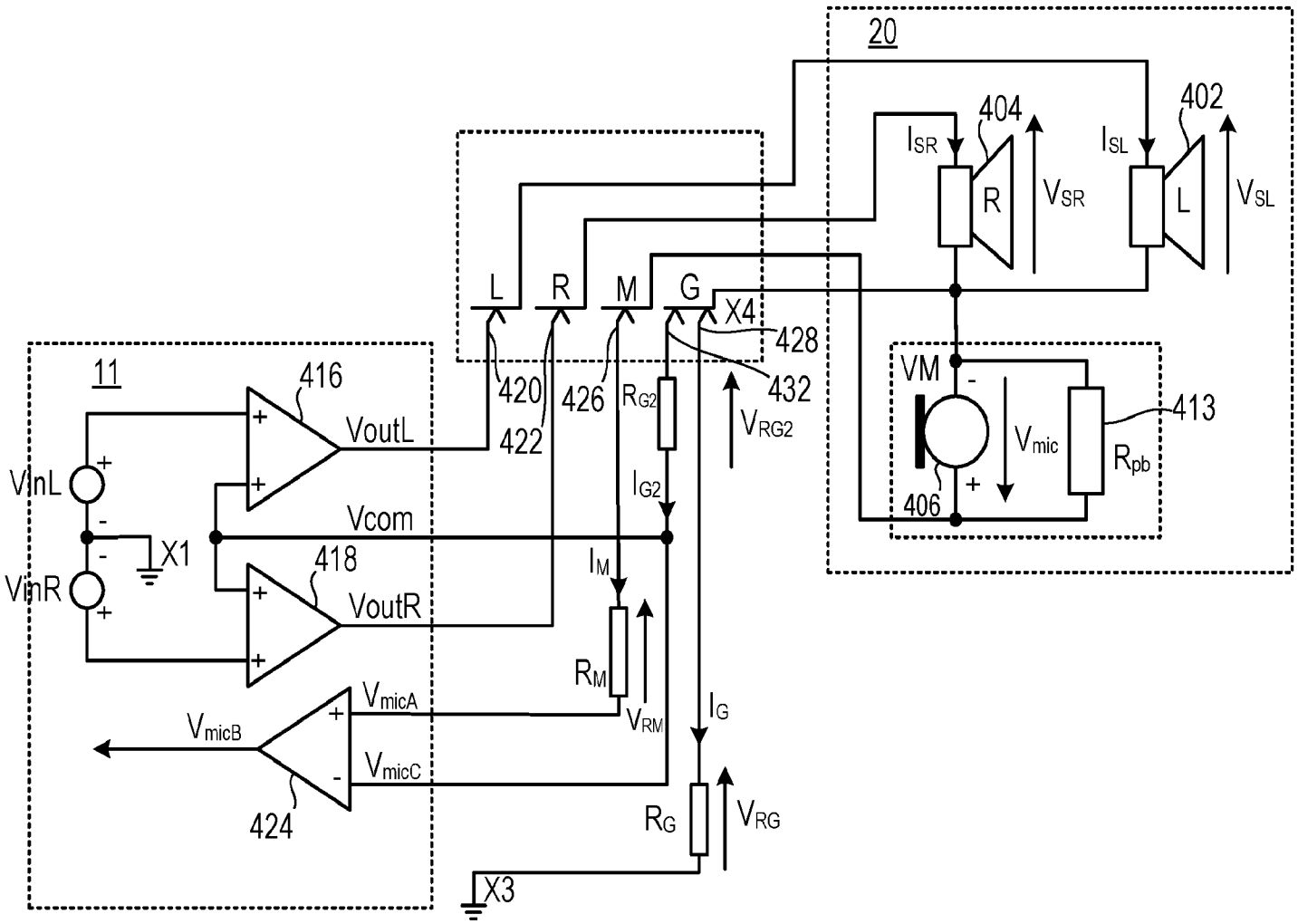
FIG. 4*a* is a circuit diagram of an audio system as shown in FIG. 3.

FIG. 4*a* is an electrical circuit diagram of a system of the general type shown in FIG. 3 comprising an embodiment.

Thus, FIG. 4*a* shows the left speaker 402, the right speaker 404, and the microphone 406 of the headset 20. The headset 20 is provided with a plug 25, which in this example is a TRRS jack plug. As shown in more detail in FIG. 4*b*, the left speaker 402 is connected between the tip (T) 408 and the sleeve (S) 410 of the plug 25. The right speaker 404 is connected between the first ring (R1) 412 and the sleeve (S) 410 of the plug 25. The microphone 406 is connected between the second ring (R2) 414 and the sleeve (S) 410 of the plug 25. Thus, the sleeve (S) 410 acts as a common ground return.

The tip 408, first ring 412, second ring 414 and sleeve 410 of this plug may thus be regarded as the L, R, M and G poles respectively of the jack plug 25.

In the circuitry 11, as illustrated in FIG. 4*a*, a left driver amplifier 416 is driven from a signal source VinL and produces a buffered output signal VoutL, and a right driver amplifier 418 is driven from a signal source VinR and produces a buffered output signal VoutR. The signal sources VinL and VinR may for example comprise digital-to-analog converters (DACs). Outputs of these driver amplifiers 416, 418 are coupled to respective jack socket contacts 420, 422.

FIG. 4*a* also shows an amplifier 424 serving as a microphone pre-amplifier with an input coupled to a jack socket contact 426.

A further jack socket contact 428 provides the common ground return path for the signal paths through the other three jack socket contacts.

Thus, when the jack plug is inserted into the jack socket, the tip contact 408 of the plug 25 contacts the jack socket contact 420; the first ring contact 412 of the plug 25 contacts the jack socket contact 422; the second ring contact 414 of the plug 25 contacts the jack socket contact 426; and the sleeve contact 410 of the plug 25 contacts the jack socket contact 428.

As shown in FIG. 4*a*, the jack socket is provided with an additional jack socket contact 432. The additional jack socket contact 432 is positioned in the socket such that, when the plug 25 is inserted into the socket, the sleeve contact 410 of the plug 25 contacts the additional jack socket contact 432 as well as the jack socket contact 428.

The additional jack socket contact 432 is connected to a second input of the microphone amplifier 424. Preferably, amplifier 424 is designed to produce an output $V_{micB}$ that depends on the difference between its two inputs $V_{micA}$ and $V_{micC}$.

The additional jack socket contact 432 is also connected to respective second inputs of the left driver amplifier 416 and the right driver amplifier 418. The common voltage on these second inputs is denoted Vcom. Preferably, amplifier 416 is designed to produce an output VoutL which depends on the sum of VinL and Vcom, while amplifier 418 is similarly designed such that VoutR depends on the sum of VinR and Vcom. Preferably amplifiers 416 and 418 are identical in design or at least very similar, so as to provide well-matched signal paths from their respective inputs to their respective outputs. The respective second inputs of the amplifiers 416, 418 and 424 may be denoted the reference inputs for the amplifiers.

FIG. 4*a* illustrates the various parasitic resistances in the ground path between the jack pole G, i.e. node X4, and a ground reference point, i.e. node, X3 close to the circuitry 11, lumped into a single resistance element $R_G$. These parasitic resistances may comprise the contact resistance of jack socket contact 428, solder resistance associated with the connection of pins of an associated jack socket terminals to a PCB on which the socket is mounted, trace resistance of any PCB track in the path, resistance of any cabling in the path, contact resistance associated with any edge connectors or suchlike between cables and PCBs or between PCBs, or many other possible parasitic or added series elements. In some embodiments there may also be one or more switches in this path, to allow reconfiguration of the socket contacts to accommodate different types of accessory, and any such switches may have significant associated contact or active device on-resistance.

There may also be similar parasitic resistances, including a jack contact resistance component, between the jack pole M and the microphone pre-amplifier 424, and FIG. 4*a* illustrates these as lumped into a single resistance element $R_M$. Similarly, any parasitic resistances associated with the path associated with the additional jack socket contact 432 are illustrated in FIG. 4*a* lumped together as the resistance element $R_{G2}$. To explain the operation of the circuit it may be assumed that the second or reference inputs of the left driver amplifier 416 and the right driver amplifier 418 that are connected to Vcom, and the inputs of the microphone amplifier 424 that are connected to $V_{micA}$ and $V_{micC}$ are all high impedance inputs. Hence, there will be negligible currents $I_M$ and $I_{G2}$ flowing through the respective parasitic resistances $R_M$ and $R_{G2}$ associated with the tracks to these inputs, and thus the voltage drops $V_{RM}$ and $V_{RG2}$ will also be negligible. Similarly if there are any parasitic resistances (not illustrated) associated with any separate (i.e. not shared) segments of paths between the illustrated shared impedance $R_{G2}$ and the driver or microphone amplifier inputs any resulting voltage drops will also be negligible.

The current $I_G$ through the ground pole G of the jack plug comprises both the currents $I_{SL}$ and $I_{SR}$ through the left and right speakers 402, 404. Thus, ignoring any current through the M pole of the plug that might return via pole G:

$$I_G=I_{SL}+I_{SR}.$$

Given that any current flowing through contact 432 may be negligible compared with that flowing through contact 428, the whole of $I_G$ will flow through parasitic resistance $R_G$, and so the ground voltage on the G pole of the jack, at node X4, will differ from that at node X3 by a voltage $V_{RG}$, where:

$$V_{RG}=I_G*R_G.$$

The voltage actually appearing across each speaker 402, 404 will be the voltage generated by the respective drive amplifier 416, 418, reduced by $V_{RG}$. That is:

$$V_{SL}=V\text{out}L-V_{RG}\text{and}$$

$$V_{SR}=V\text{out}R-V_{RG}$$

As mentioned above, amplifiers 416 and 418 are configured such that VoutL=VinL+Vcom, and VoutR=VinR+Vcom. Moreover, as $V_{RG2}$ is negligible, Vcom=$V_{RG}$.

Thus:

$$V_{SL}=V\text{out}L-V_{RG}=(V\text{in}L+V\text{com})-V_{RG}=(V\text{in}L+V_{RG})-V_{RG}=V\text{in}L,\text{ and}$$

$$V_{SR}=V\text{out}R-V_{RG}=(V\text{in}R+V\text{com})-V_{RG}=(V\text{in}R+V_{RG})-V_{RG}=V\text{in}R.$$

Thus, $V_{SL}$=VinL and $V_{SR}$=VinR, and there is no crosstalk signal at the speakers 402, 404.

As also mentioned above amplifier 424 is configured such that:

$$V_{micB}=V_{micA}-V_{mic}.$$

Considering the voltages shown in FIG. 4*a:*

$$V_{micA}=V_{mic}+V_{RG}-V_{RM}\text{ and}$$

$$V_{micC}=V_{RG}-V_{RG2}.$$

However, as mentioned above, $V_{RM}$ and $V_{RG2}$ are negligible, and so:

$$V_{micB}=V_{micA}-V_{mic}=(V_{mic}+V_{RG})-V_{RG}=V_{mic}.$$

Thus the net voltage appearing at the output of the microphone preamplifier 424 is equal to $V_{mic}$ (possibly with a voltage gain applied, depending on the configuration of the amplifier 424).

Any other interference appearing at the jack pole G, i.e. any other additional component of $V_{RG}$ superimposed on $I_G \cdot R_G$, due for instance to rectified EMI (electromagnetic interference) will also be removed from the net speaker drive and microphone sense signals.

Figure 4B:
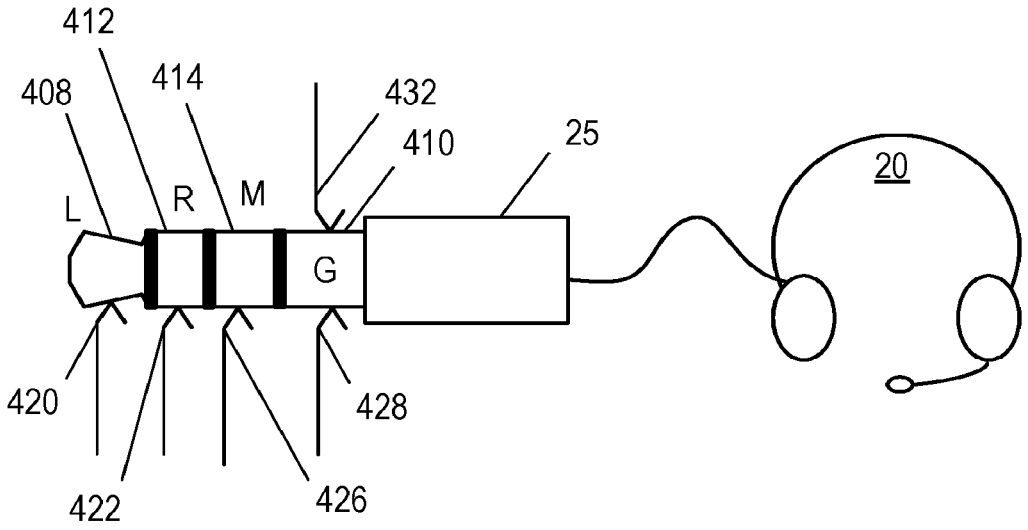
FIG. 4*b* illustrates a plug and socket in the audio system of FIG. 4.

The additional socket contact 432 may be implemented mechanically in various forms depending on the application. FIG. 4*a* illustrates a construction where the additional contact 432 may be located on the same side of the jack plug as the contact 428. In other embodiments, where space and the mechanical construction technology allow, the additional contact 432 may be substantially on the opposite side of the jack plug from the contact 428, as illustrated in FIG. 4*b*, and displaced further along the plug in a direction parallel with the axis of the plug. Other mechanical configurations are of course possible.

Figure 5A:
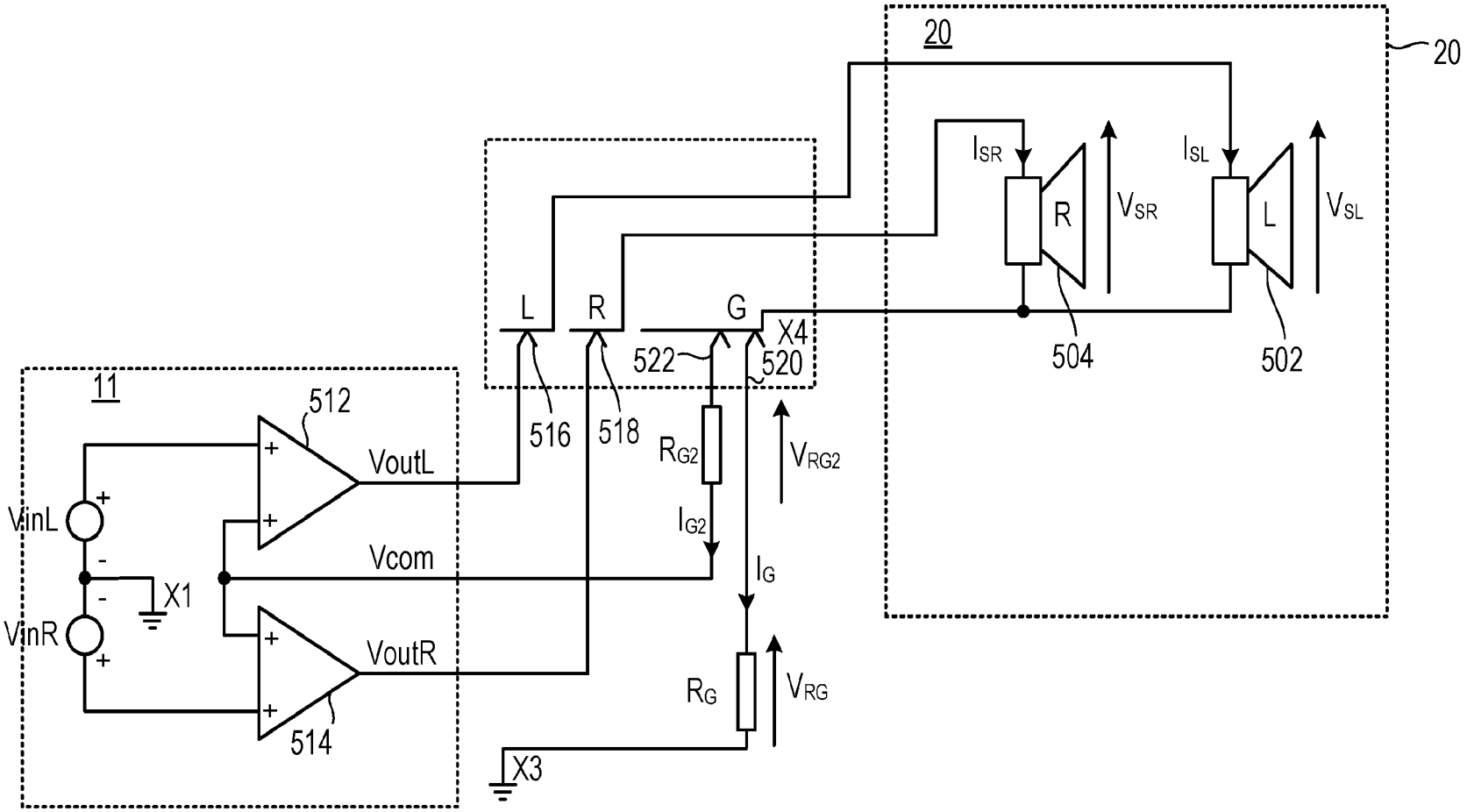
FIG. 5*a* is a circuit diagram of an alternative audio system as shown in FIG. 3.

FIG. 5*a* is an electrical circuit diagram of a system similar to that shown in FIG. 4*a* but without a microphone in the accessory.

Figure 5B:
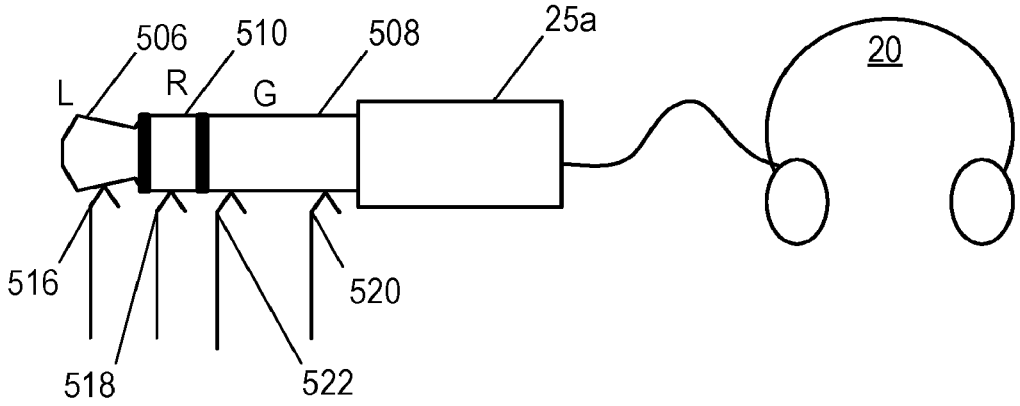
FIG. 5*b* illustrates a plug and socket in the audio system of FIG. 5.

Thus, FIG. 5*a* shows the left speaker 502 and the right speaker 504 of the headset 20. The headset 20 is provided with a jack plug 25*a*, which in this example is a 3-pole TRS plug. As shown in FIG. 5*b*, the left speaker 502 is connected between the tip (T) 506 and the sleeve (S) 508 of the plug 25. The right speaker 504 is connected between the ring (R) 510 and the sleeve (S) 508 of the plug 25. Thus, the sleeve 508 acts as a common ground return.

The tip 506, ring 510 and sleeve 508 of this plug may thus be regarded as the L, R and G poles respectively of the jack plug 25*a*.

In the circuitry 11, a left driver amplifier 512 is driven from a signal source VinL and produces a buffered output signal VoutL, and a right driver amplifier 514 is driven from a signal source VinR and produces a buffered output signal VoutR. The signal sources VinL and VinR may for example comprise digital-to-analog converters (DACs). The driver amplifiers 512, 514 are coupled to respective jack socket contacts 516, 518.

A third jack socket contact 520 provides the common ground return path for the signal paths through the other two jack socket contacts 516, 518.

Thus, when the jack plug 25*a* is inserted into the jack socket, the tip contact 506 of the plug 25*a* contacts the jack socket contact 516; the ring contact 510 of the plug 25*a* contacts the jack socket contact 518; and the sleeve contact 508 of the plug 25*a* contacts the jack socket contact 520.

As shown in FIG. 5*a*, the jack socket is provided with an additional, i.e. a fourth, jack socket contact 522. The additional jack socket contact 522 is positioned in the socket such that, when the plug 25*a* is inserted into the socket, the sleeve contact 508 of the plug 25*a* contacts the additional jack socket contact 522 as well as the jack socket contact 520.

The additional jack socket contact 522 is connected to respective second, i.e. reference, inputs of the left driver amplifier 512 and the right driver amplifier 514. The voltage on these second inputs is denoted Vcom. Preferably, amplifier 512 is designed to produce an output VoutL which depends on the sum of VinL and Vcom, and amplifier 514 is designed similarly to provide an output VoutR which depends on the sum of VinR and Vcom.

FIG. 5*a* illustrates the various parasitic resistances in the ground path between the jack pole G and a ground reference point X3 close to the circuitry 11, lumped into a single resistance element $R_G$.

There may also be similar parasitic resistances between the jack plug pole G and the driver amplifiers via socket contact 522, and FIG. 5*a* illustrates these as lumped into a single resistance element $R_{G2}$.

It can be assumed that the inputs of the left driver amplifier 512 and the right driver amplifier 514 connected to Vcom are high impedance. Hence, there will be a negligible current $I_{G2}$ flowing in the parasitic resistance $R_{G2}$ associated with the tracks to these inputs, and thus the voltage drop $V_{RG2}$ will also be negligible.

The current $I_G$ through the ground pole G of the jack plug 25*a* is the sum of the currents $I_{SL}$ and $I_{SR}$ through the left and right speakers 502, 504. That is:

$$I_G=I_{SL}+I_{SR}.$$

Given that any current flowing through contact 522 may be negligible compared with that flowing through contact 520 the whole of $I_G$ will flow through parasitic resistance $R_G$, and so the ground voltage on the pole G of the jack, at node X4, will differ from that at node X3 by a voltage $V_{RG}$, where:

$$V_{RG}=I_G*R_G.$$

The voltage actually appearing across each speaker 502, 504 will be the voltage generated by the respective drive amplifier 512, 514, reduced by $V_{RG}$. That is:

$$V_{SL}=V\text{out}L-V_{RG} \text{ and}$$

$$V_{SR}=V\text{out}R-V_{RG}$$

As mentioned above, driver amplifiers 512 and 514 are configured such that VoutL=VinL+Vcom, and VoutR=VinR+Vcom. Moreover, as $V_{RG2}$ is negligible, Vcom=$V_{RG}$.

Thus:

$$V_{SL}=V\text{out}L—V_{RG}=(V\text{in}L+V\text{com})-V_{RG}=(V\text{in}L+V_{RG})-V_{RG}=V\text{in}L, \text{ and}$$

$$V_{SR}=V\text{out}R-V_{RG}=(V\text{in}R+V\text{com})-V_{RG}=(V\text{in}R+V_{RG})-V_{RG}=V\text{in}R.$$

Thus, $V_{SL}$=VinL and $V_{SR}$=VinR, and there is no crosstalk signal at the speakers 502, 504.

Any other interference appearing at the jack pole, i.e. any other additional component of $V_{RG}$ superimposed on $I_G \cdot R_G$, due for instance to rectified EMI (electromagnetic interference) or to ground return currents from other circuitry will also be removed from the net speaker drive signals.

The additional jack socket contact 522 may be implemented mechanically in various forms depending on the application. FIG. 5*b* illustrates a construction where the additional contact 522 may be located on the same side of the jack plug as the contact 520. In other embodiments where space and the mechanical construction technology allow, the additional contact 522 may be substantially on the opposite side of the jack plug from the contact 520. Other mechanical configurations are of course possible.

Figure 6A:
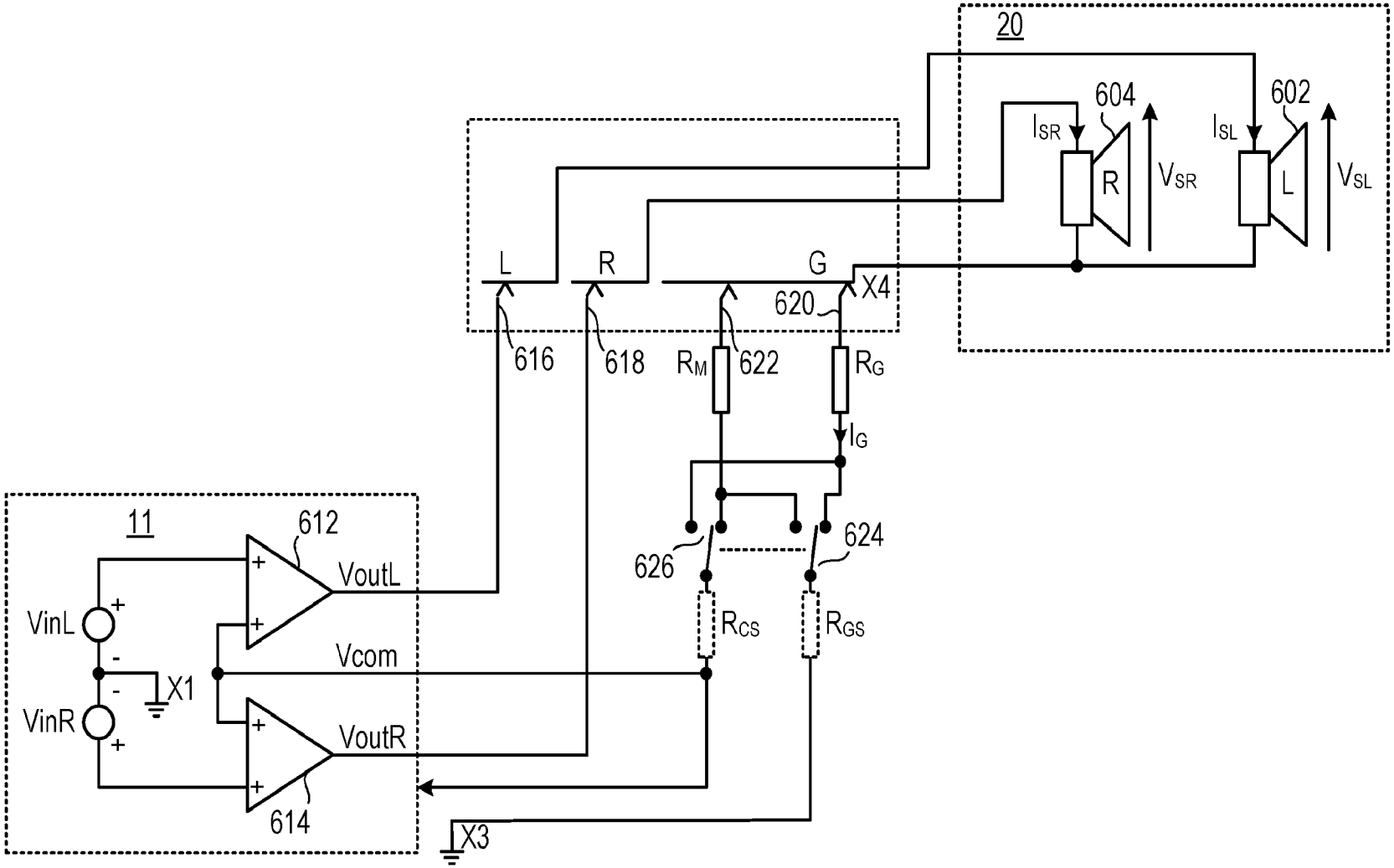
FIG. 6*a* is a circuit diagram of a further alternative audio system as shown in FIG. 3.

FIG. 6*a* is an electrical circuit diagram of an alternative system of the type shown in FIG. 3, but again in which the accessory 20 currently attached does not have a microphone. The host device is however adapted so as to be able to operate in alternative configurations so as to co-operate with other accessories which may have microphones or other components coupled to poles of their respective plugs. These alternative configurations are enabled by means of a plurality of switches which may comprise switches illustrated as elements 626 and 624 and may also comprise other switches according to the configurations to be enabled.

Thus, FIG. 6*a* shows the left speaker 602 and the right speaker 604. The headset 20 is provided with a jack plug 25*b*, which in this example is a 3-pole TRS plug. As illustrated in conjunction with FIG. 6*b*, the left speaker 602 is connected between the tip (T) 606 and the sleeve (S) 608 of the plug 25*b*. The right speaker 604 is connected between the ring (R) 610 and the sleeve (S) 608 of the plug 25*b*. Thus, the sleeve 608 acts as a common ground return.

The tip 606, ring 610 and sleeve 608 of this plug may thus be regarded as the L, R and G poles respectively of the jack plug 25*b*.

In the circuitry 11, a left driver amplifier 612 is driven from a signal source VinL and produces a buffered output signal VoutL, and a right driver amplifier 614 is driven from a signal source VinR and produces a buffered output signal VoutR. The signal sources VinL, VinR may for example comprise digital-to-analog converters (DACs). These driver amplifiers 612, 614 are coupled to respective jack socket contacts 616, 618. Driver amplifiers 612 and 614 may be configured such that VoutL=VinL+Vcom, and VoutR=VinR+Vcom where Vcom is a voltage applied to a pair of respective second, i.e. reference, inputs of these driver amplifiers 612 and 614.

Figure 6B:
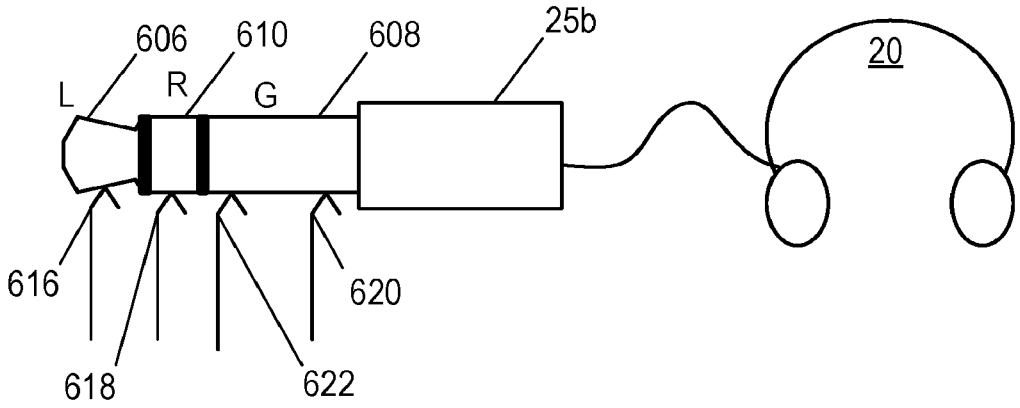
FIG. 6*b* illustrates a plug and socket in the audio system of FIG. 6*a*.

The jack socket is mechanically configured such that when the jack plug 25*b* is inserted into the jack socket, the tip contact 606 of the plug 25*b* contacts the jack socket contact 616; the ring contact 610 of the plug 25*b* contacts the jack socket contact 618; and the sleeve contact 608 of the plug 25*b* contacts the jack socket contact 620. As shown in FIGS. 6*a* and 6*b*, the jack socket is provided with an additional jack socket contact 622. The additional, i.e. fourth, jack socket contact 622 is positioned in the socket such that, when the plug 25*b* is inserted into the socket, the sleeve contact 608 of the plug 25*b* contacts the additional jack socket contact 622 as well as the jack socket contact 620.

Thus, similarly to the embodiment illustrated in FIGS. 5*a* and 5*b*, the jack socket comprises a plurality of jack contacts which are mechanically configured to mate with the common ground return pole G of a TRS plug when such a plug is inserted. However, in this particular embodiment, rather than one contact being permanently configured to provide a low impedance ground current return path to ground while the other is permanently dedicated to couple to driver amplifiers, in this embodiment each is connected to respective poles of each switch 624 and 626. The other terminal of first switch 624 is coupled to ground at a ground reference point X3. The other terminal of second switch 626 may be coupled to driver amplifiers or other circuitry comprised in circuitry 11, which may comprise microphone amplifiers or other functions.

When the host device is configured to co-operate with the TRS plug of FIG. 6*b*, the first switch 624 may be controlled to couple the jack plug pole G via one socket contact 620 to ground reference point X3 while the second switch 626 may be controlled to couple the jack plug pole G via the other socket contact 622 to the pair of respective second inputs of the left driver amplifier 612 and the right driver amplifier 614, i.e. to the signal line Vcom. Alternatively the roles of switches 624 and 626 may be interchanged such that jack plug pole G is coupled to ground X3 via switch 626 and to Vcom via switch 624.

FIG. 6*a* illustrates the various parasitic resistances in the ground path from the jack pole G via socket contact 620 to the switches 624 and 626, lumped into a single resistance element $R_G$. Similarly FIG. 6*a* illustrates the various parasitic resistances in the ground path from the jack pole G via socket contact 622 to the switches 624 and 626, lumped into a single resistance element $R_M$.

The parasitic resistances associated with the switch 624 are illustrated in FIG. 6*a* lumped together as the resistance element $R_{GS}$, and the resistances associated with the switch 626 are shown in FIG. 6*a* lumped together as the resistance element $R_{CS}$.

Assuming the case where ground pole G is coupled to ground reference point X3 via the contact 620 and the switch 624, and to Vcom via the contact 622 and the switch 626, and assuming that the inputs of the left driver amplifier 612 and the right driver amplifier 614 connected to Vcom are high impedance, there will be negligible currents flowing in the parasitic resistances $R_M$ and $R_{CS}$ associated with the path from pole G to Vcom, and thus any associated voltage drop will be negligible.

The current $I_G$ through the ground pole G of the jack plug is the sum of the currents $I_{SL}$ and $I_{SR}$ through the left and right speakers 602, 604. That is:

$$I_G=I_{SL}+I_{SR}.$$

Considering the case where ground pole G is coupled to ground reference point X3 via the contact 620 and the switch 624, and given that any current flowing through contact 622 may be negligible compared with that flowing through contact 620 the whole of $I_G$ will flow through parasitic resistance $R_G$, and so the ground voltage on the pole of the jack, at node X4, will differ from that at X3 by a voltage $V_{RG}$, where:

$$V_{RG}=I_G*(R_G+R_{GS}).$$

The voltage actually appearing across each speaker 602, 604 will be the voltage generated by the respective drive amplifier 614, 614, reduced by $V_{RG}$. That is:

$$V_{SL}=V\text{out}L-V_{RG} \text{ and}$$

$$V_{SR}=V\text{out}R-V_{RG}.$$

As mentioned above, the driver amplifiers 612 and 614 may be configured such that VoutL=VinL+Vcom, and VoutR=VinR+Vcom. Moreover, as any voltage drop between plug pole G and Vcom is negligible, Vcom=$V_{RG}$. Thus:

$$V_{SL}=V\text{out}L-V_{RG}=(V\text{in}L+V\text{com})-V_{RG}=(V\text{in}L+V_{RG})-V_{RG}=V\text{in}L, \text{ and}$$

$$V_{SR}=V\text{out}R-V_{RG}=(V\text{in}R+V\text{com})-V_{RG}=(V\text{in}R+V_{RG})-V_{RG}=V\text{in}R.$$

Thus, $V_{SL}$=VinL and $V_{SR}$=VinR, and there is no crosstalk signal at the speakers 602, 604.

Any other interference appearing at the jack pole, i.e. any other additional component of $V_{RG}$ superimposed on $I_G \cdot R_G$, due for instance to rectified EMI or to ground return currents from other circuitry will also be removed from the net speaker drive signals.

The additional jack socket contact 622 may be implemented mechanically in various forms depending on the application. FIG. 6*a* illustrates a construction where the additional contact 622 may be located on the same side of the jack plug as the contact 620. In other embodiments where space and the mechanical construction technology allow, the additional contact 622 may be substantially on the opposite side of the jack plug from the contact 620. Other mechanical configurations are of course possible.

Figure 6C:
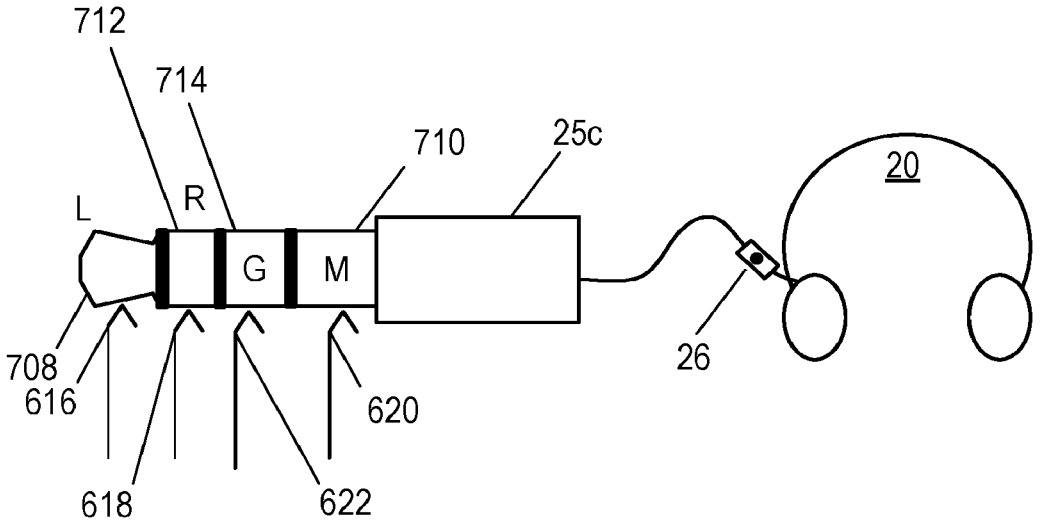
FIG. 6*c* illustrates an alternative form of a plug and socket in the audio system of FIG. 6*a*.
Figure 6D:
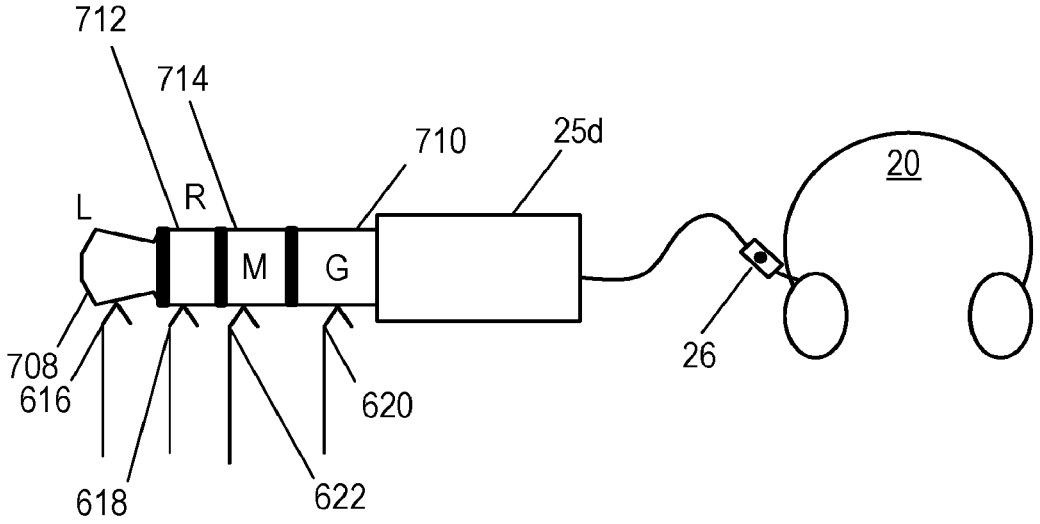
FIG. 6*d* illustrates an alternative form of a plug and socket in the audio system of FIG. 6*a*.

FIGS. 6*c* and 6*d* illustrate examples of accessories with which a host device similar to that discussed with respect to FIGS. 6*a* and 6*b* might be configured to co-operate.

Figure 6E:
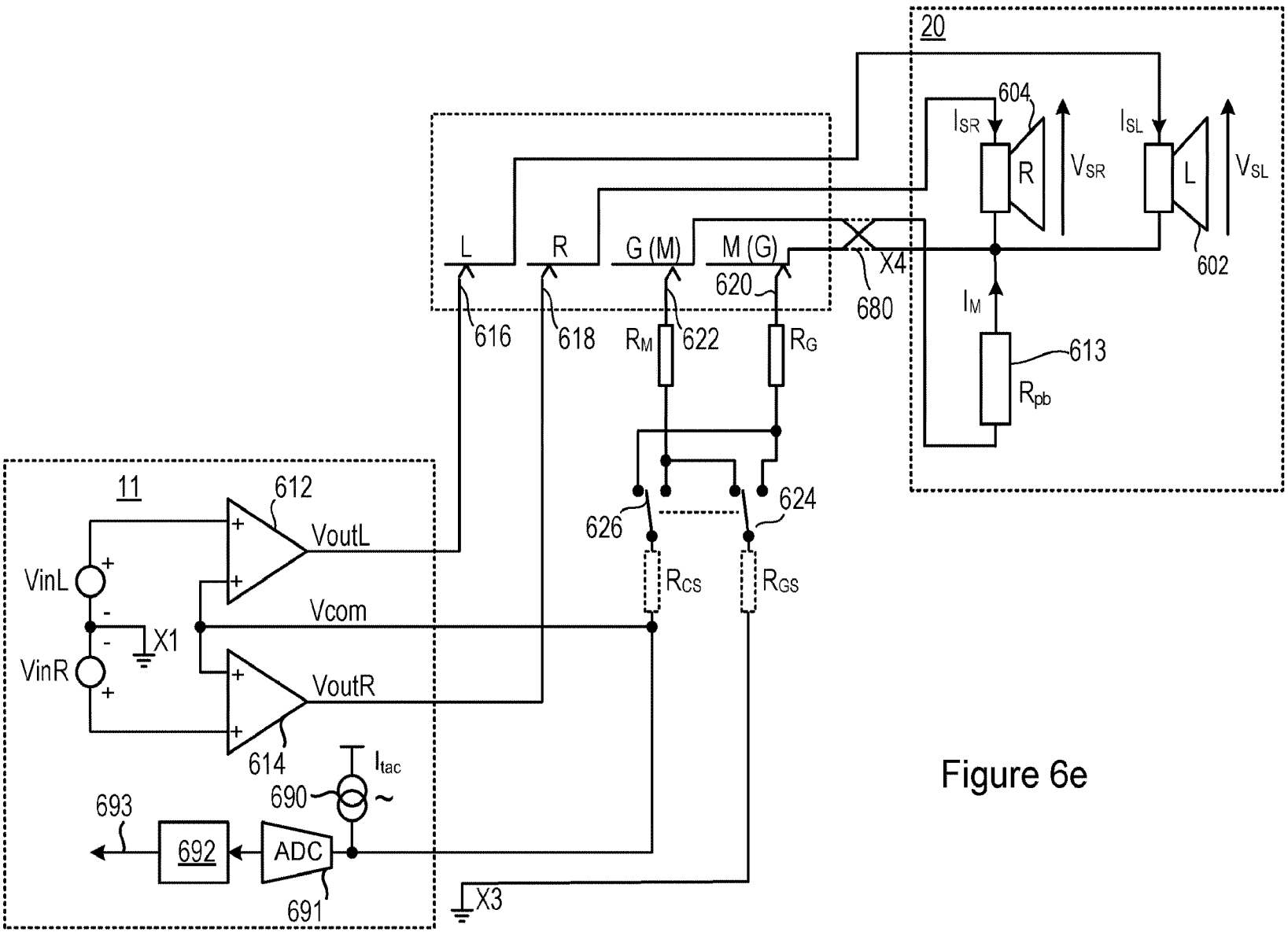
FIG. 6*e* is a circuit diagram of a further alternative audio system as shown in FIG. 3.

FIG. 6*c* in conjunction with FIG. 6*e* illustrates an accessory which comprises speakers 602, 604 connected to the tip 708 and first ring 712 of the jack. However in this accessory the common ground return of the speakers is connected to the second ring 714 of the jack rather than the sleeve. The sleeve 710 is connected to an array of one or more push-buttons in a module 26, which define a resistance Rpb between the sleeve and the common ground return. This resistance varies according to which buttons are pushed. In some cases one of the resistance values could essentially be zero, for example less than 1 ohm or less than 100 milohm or be essentially just the parasitic resistance of the cabling and switch contact resistance.

The tip 708, first ring 712, second ring 714 and sleeve 710 of this plug may thus be regarded as the L, R, G and M poles respectively of the jack plug 25*e*.

In use the ground pole G of the jack may be coupled to ground via socket contact 622 and switch 624. The sleeve of the jack plug, i.e. pole M, is coupled to circuitry 11 via socket contact 620 and switch 626. In order for circuitry 11 to be able to measure the resistance Rpb without audio artefacts, an a.c. signal current as illustrated by a.c. current source 690 of frequency outside the audio bandwidth or outside the passband of the speaker frequency response may be injected onto Rpb via switch 626, contact 620 and jack plug pole M and the resulting a.c. voltage monitored, for example by an ADC 691 as illustrated or by some analog amplitude detector. By means of circuitry 692 configured to compare the a.c. voltage or apparent impedance versus various predefined ranges consistent with the resistances corresponding to various push-button activations, the button or buttons activated may be detected, and control signals 693 generated to request corresponding action to be taken in the host device, for example to increase or decrease the playback volume or to start, pause or terminate playback.

By arguments similar to those above, when $R_{pb}$ is set to a low value, of the same order as the parasitic resistances $R_G$, $R_M$ etc., and the driver amplifiers present an adequately high input impedance at Vcom then there will be negligible current or voltage drop associated with resistances $R_{pb}$, $R_G$ and $R_{CS}$, and so the ground sense voltage monitored by Vcom will be equal to the voltage drop $V_{RG}$ between jack ground node X4 and the ground reference node X3. Thus there will be no crosstalk between the speakers. Even for higher values of $R_{pb}$, say of the order of one kilohm, provided that the input impedance of the driver amplifiers and any other circuitry connected to Vcom is adequately high, say greater than 100 kilohm or than 1 Megohm, the current flowing from $R_{pb}$ into Vcom will be low enough to still give greatly improved crosstalk over a circuit scheme without Vcom (i.e. a scheme equivalent to shorting Vcom to ground X3).

FIG. 6*d* illustrates a similar accessory, but this accessory has poles G and M reversed (as illustrated by the dotted alternative connections 680 in FIG. 6*e*). Thus the sleeve 710 is the common ground or pole G and the second ring is used as the signalling pole M.

This variant of accessory can be accommodated merely by switching both switches to the other position. That is, the ground pole G of the jack may be coupled to ground via socket contact 620 and switch 624. The second ring of the jack plug, i.e. pole M, is coupled to circuitry 11 via socket contact 622 and switch 624.

Again for an adequately high input impedance at Vcom, then there will be negligible current or voltage drop associated with resistances $R_{pb}$, $R_G$ and $R_{CS}$, and so Vcom will follow $V_{RG}$ and be superimposed on VinL and VinR and speaker crosstalk will be greatly improved.

In a further variant of accessories illustrated in FIGS. 6*c*, 6*d* and 6*e*, the pushbutton resistance Rpb may be replaced by a short circuit. Thus either of the G and M poles of the plug may both carry the ground return current from the speakers and the other may be used to sense the ground voltage at the speakers. The parasitic resistance of the wires between plug and cable may be lumped together with RG or RM, and again the voltage drop across the sense path will be negligible, and the driver amplifiers will deliver output voltages with the sensed speaker ground voltage superimposed.

Figure 7A:
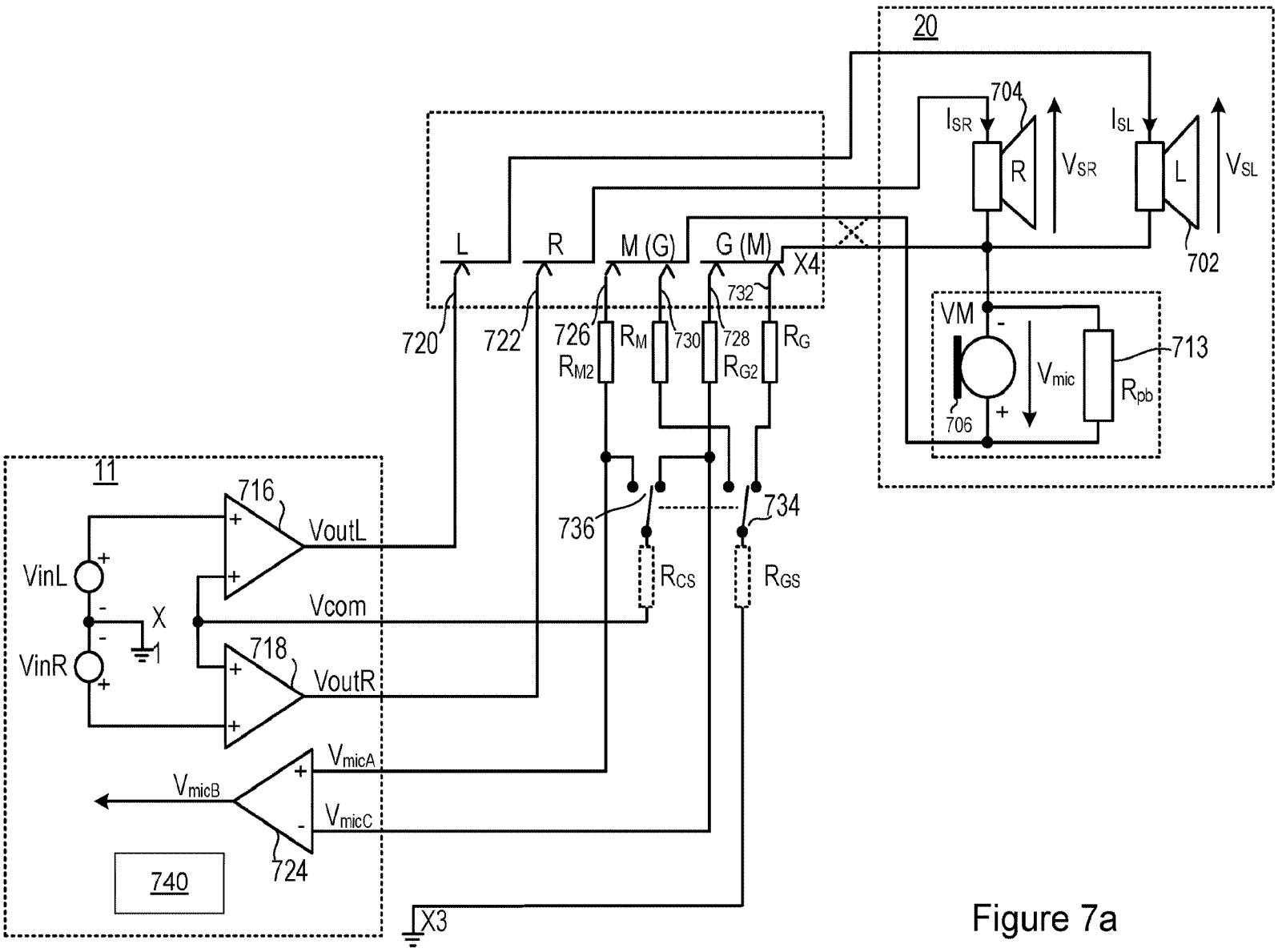
FIG. 7*a* is a circuit diagram of a further alternative audio system as shown in FIG. 3.

FIG. 7*a* is an electrical circuit diagram of a further alternative system of the general type shown in FIG. 3 illustrating a further embodiment.

Thus, FIG. 7*a* shows the left speaker 702, the right speaker 704, and the microphone 706 of the headset 20. The headset 20 is provided with a jack plug, which in this example is a TRRS plug. The host device in this system comprises a socket, switches and circuitry 11 such that it can accommodate accessories that have plugs that are connected with different ground and microphone connections.

Figure 7B:
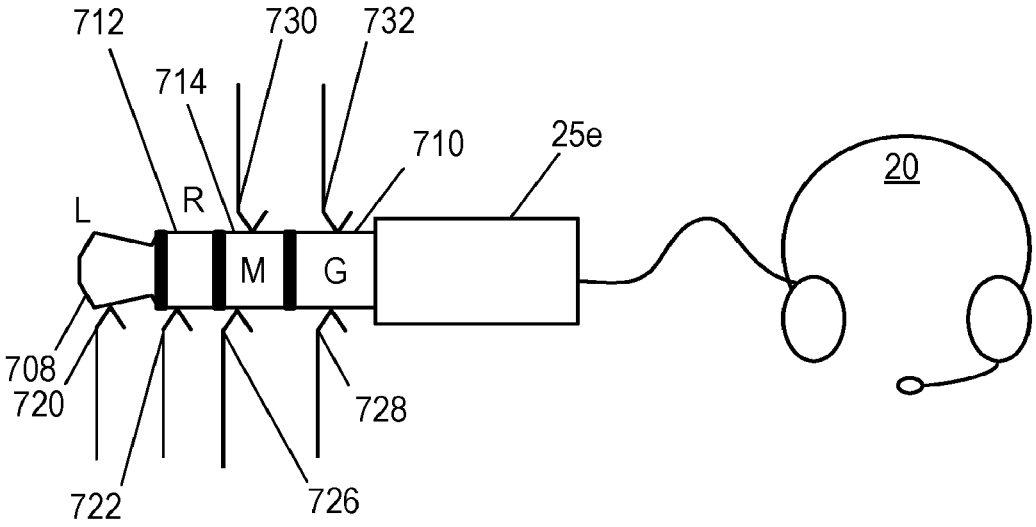
FIGS. 7*b* and 7*c* illustrate embodiments of a plug and socket in the audio system of FIG. 7*a*.
Figure 7C:
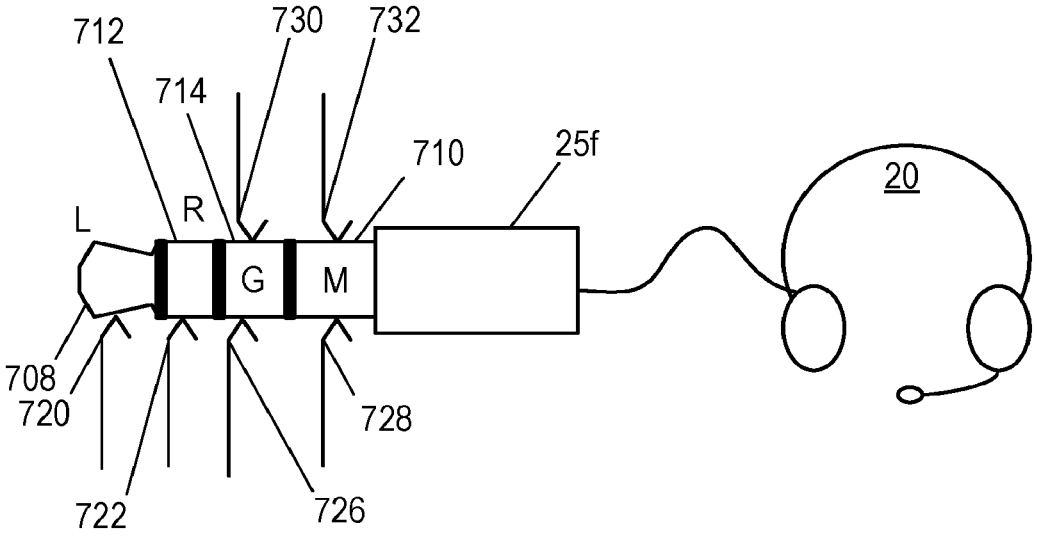

FIG. 7*b* shows a jack plug 25*e* connected according to the OMTP standard, and FIG. 7*c* shows a jack plug 25*f* connected according to the CTIA standard, and both figures show the connections between mating contacts in these plugs and the socket arrangement as also illustrated in FIG. 7*a*.

More specifically, in the case of the OMTP jack plug 25*e* of FIG. 7*b*, the common ground return connection is through the sleeve 710, and the microphone is connected to the second ring 714. The left speaker 702 is therefore connected between the tip (T) 708 and the sleeve (S) 710 of the plug 25*e*. The right speaker 704 is connected between the first ring (R1) 712 and the sleeve (S) 710 of the plug 25*e*. The microphone 706 is therefore connected between the second ring (R2) 714 and the sleeve (S) 710 of the plug 25. Thus, the second ring 714 acts as a common ground return.

The tip 708, first ring 712, second ring 714 and sleeve 701 of this plug may thus be regarded as the L, R, M and G poles respectively of the jack plug 25*e*.

In the case of the CTIA jack plug 25*f* of FIG. 7*c*, the common ground return connection is through the second ring 714, and the microphone is connected to the sleeve 710.

The left speaker 702 is therefore connected between the tip (T) 708 and the second ring 714 of the plug 25*f*. The right speaker 704 is connected between the first ring (R1) 712 and the second ring 714 of the plug 25*f*. The microphone 706 is connected between the sleeve (S) 710 and the second ring (R2) 714 of the plug 25*f*. Thus, the second ring 714 acts as a common ground return.

The tip 708, first ring 712, second ring 714 and sleeve 701 of this plug may thus be regarded as the L, R, G and M poles respectively of the jack plug 25*e*.

In the circuitry 11, a left driver amplifier 716 is driven from a signal source VinL and produces a buffered output signal VoutL, and a right driver amplifier 718 is driven from a signal source VinR and produces a buffered output signal VoutR. The signal sources VinL and VinR may for example comprise digital-to-analog converters (DACs). These driver amplifiers 716, 718 are coupled to respective jack socket contacts 720, 722. Driver amplifiers 716 and 718 may be configured such that VoutL=VinL+Vcom, and VoutR=VinR+Vcom where Vcom is a voltage applied to a pair of respective second inputs of these driver amplifiers 716 and 718. These second inputs are connectable via the switch 736 to the jack socket contact 728 or to the jack socket contact 726.

FIG. 7*a* also shows an amplifier 724 serving as a microphone pre-amplifier coupled via two separate inputs to two jack socket contacts 726 and 728. Amplifier 724 is designed to produce an output $V_{micB}$ that depends on the difference between its two inputs $V_{micA}$ and $V_{micC}$.

The switch 734 is positioned to be able to connect the further jack socket contact 730 or further jack socket contact 732 to the ground point X3.

When a jack plug such as 25*e* or 25*f* is inserted into the jack socket, the tip contact 708 of the plug contacts the jack socket contact 720; the first ring contact 712 of the plug contacts the jack socket contact 722; the second ring contact 714 of the plug contacts the jack socket contacts 726 and 730; and the sleeve contact 710 of the plug contacts the jack socket contacts 728 and 732.

The circuitry 11 may be provided with circuitry 740 for determining the type of jack plug that has been inserted. That is, the circuitry 11 is able to determine the positions of the ground and microphone connections in the inserted jack plug, and hence whether it is a jack plug 25*e* connected according to the OMTP standard as shown in FIG. 7*b* or a jack plug 25*f* connected according to the CTIA standard as shown in FIG. 7*c*. There are many techniques known for this, generally involving injecting current into one or more contacts of the jack socket and measuring voltages at one or more other contacts or vice versa to determine the impedances between various contacts due to the components connected to the corresponding poles of the inserted jack plug. Thus circuitry 740 may be coupled to various ones of jack socket contacts 720, 722, 726, 728, 730 or 732 via switches 734 or 736 or other wired paths or switches to drive or sense voltage or current signals comprising signal levels or tones on these contacts.

If the ground pole G is determined to be in the sleeve of the jack plug as shown in the jack plug 25*e*, then switch 734 connects the contact 732 to the ground point X3 and the switch 736 connects the contact 728 to the second inputs of the left and right driver amplifiers 716, 718.

If the ground pole G is determined to be in the second ring (R2) of the jack plug 25 as shown in the jack plug 25*f*, then the switch 734 connects the contact 730 to the ground point X3, and the switch 736 connects the contact 726 to the second inputs of the left and right driver amplifiers 716, 718.

The parasitic resistance associated with jack socket contact 732 is $R_G$. Equivalently the parasitic resistance associated with the jack socket contact 730 is $R_M$. However, the switch 734 also has a parasitic resistance $R_{GS}$ associated with it. Therefore, the overall resistance of the ground path from the mating jack pole to the ground point X3 when the switch is connected to contact 730 Is $R_M+R_{GS}$. Equivalently, the overall resistance of the ground path from the mating jack pole to the ground point X3 when the switch is connected to the contact 732 is $R_G+R_{GS}$.

There may also be similar parasitic resistances between the microphone jack socket contacts 726 and 728, and the microphone pre-amplifier. FIG. 7*a* shows these lumped into respective single resistance elements $R_{M2}$ and $R_{G2}$.

There is also a parasitic resistance $R_{CS}$ which is associated with the switch 736. However, as it can be assumed that the inputs of the left driver amplifier 716 and the right driver amplifier 718 connected to Vcom, and the inputs of the microphone amplifier 424 connected to $V_{micA}$ and $V_{micC}$ are high impedance inputs. Hence, there will be negligible currents $I_{G2}$, $I_{CS}$ and $I_{M2}$ flowing in the respective parasitic resistances $R_{G2}$, $R_{Cs}$ and $R_{M2}$ associated with the paths to these inputs, and thus the respective voltage drops $V_{RG2}$, $V_{RCS}$ and $V_{RM2}$ will also be negligible.

The current $I_G$ through the ground pole G of the jack plug, whether this be positioned as shown in jack plug 25*e* or 25*f*, comprises both the currents $I_{SL}$ and $I_{SR}$ through the left and right speakers 702, 704. Thus, ignoring any current through the M pole of the plug:

$$I_G=I_{SL}+I_{SR}.$$

Given that substantially the whole of $I_G$ will flow through $R_G$ and $R_{GS}$, or through $R_M$ or and $R_{GS}$ depending on the switch configuration, the ground voltage on the pole of the jack, at node X4 (or node X5 depending on the position of the ground connection in the jack plug), will differ from that at node X3 by a voltage $V_{RG}$, where:

$$V_{RG}=I_G*(R_G+R_{GS}) \text{ or } I_G*(R_M+R_{GS}).$$

The voltage actually appearing across each speaker 702, 704 will be the voltage generated by the respective drive amplifier 716, 718, reduced by $V_{RG}$. That is:

$$V_{SL}=V\text{out}L-V_{RG} \text{ and}$$

$$V_{SR}=V\text{out}R-V_{RG}.$$

As mentioned above, VoutL=VinL+Vcom, and VoutR=VinR+Vcom. Moreover, as the voltage drops across parasitic resistances $R_{G2}$, $R_{Cs}$ and $R_{M2}$ will also be negligible, Vcom=$V_{RG}$.

Thus:

$$V_{SL}=V\text{out}L—V_{RG}=(V\text{in}L+V\text{com})-V_{RG}=(V\text{in}L+V_{RG})-V_{RG}=V\text{in}L, \text{ and}$$

$$V_{SR}=V\text{out}R-V_{RG}=(V\text{in}R+V\text{com})-V_{RG}=(V\text{in}R+V_{RG})-V_{RG}=V\text{in}R.$$

Thus, $V_{SL}$=VinL and $V_{SR}$=VinR, and there is no crosstalk signal at the speakers 702, 704.

As also mentioned above:

$$V_{micB}=V_{micA}-V_{mic}.$$

Considering the voltages shown in FIG. 7*a:*

$$V_{micA}=V_{mic}+V_{RG}-V_{RM2} \text{ and}$$

$$V_{micC}=V_{RG}-V_{RG2}.$$

However, as mentioned above, $V_{RM2}$ and $V_{RG2}$ are negligible, and so:

$$V_{micB}=V_{micA}-V_{mic}=(V_{mic}+V_{RG})-V_{RG}.$$

Thus, the microphone preamplifier 724 is connected across the two contacts 726, 728 that are not used for the ground current return in either position of the switches 734, 736, and so it senses the microphone signal $V_{mic}$ without any influence from the ground return current or any parasitic resistance in the socket contacts. The net voltage appearing at the output of the preamplifier 724 is therefore equal to $V_{mic}$ (probably with a voltage gain applied by the preamplifier 724).

Any other interference appearing at the jack pole, i.e. any other additional component of $V_{RG}$ superimposed on $I_G$·($R_G$+$R_{GS}$), due for instance to rectified EMI (Electromagnetic Interference) will also be removed from the net speaker drive and microphone sense signals.

The jack socket contacts 732 and 728 may be implemented mechanically in various forms depending on the application. FIG. 7*a* illustrates a construction where the additional contacts 732 and 728 may be located on opposite sides of the jack plug. In other embodiments where space and the mechanical construction technology allow, the contacts 732 and 728 may be substantially on the same side of the jack plug, and displaced along the plug in a direction parallel with the axis of the plug.

The jack socket contacts 730 and 726 may be implemented mechanically in various forms depending on the application. FIG. 7*a* illustrates a construction where the additional contacts 730 and 726 may be located on opposite sides of the jack plug. In other embodiments where space and the mechanical construction technology allow, the contacts 730 and 726 may be substantially on the same side of the jack plug, and displaced along the plug in a direction parallel with the axis of the plug.

Figure 8A:
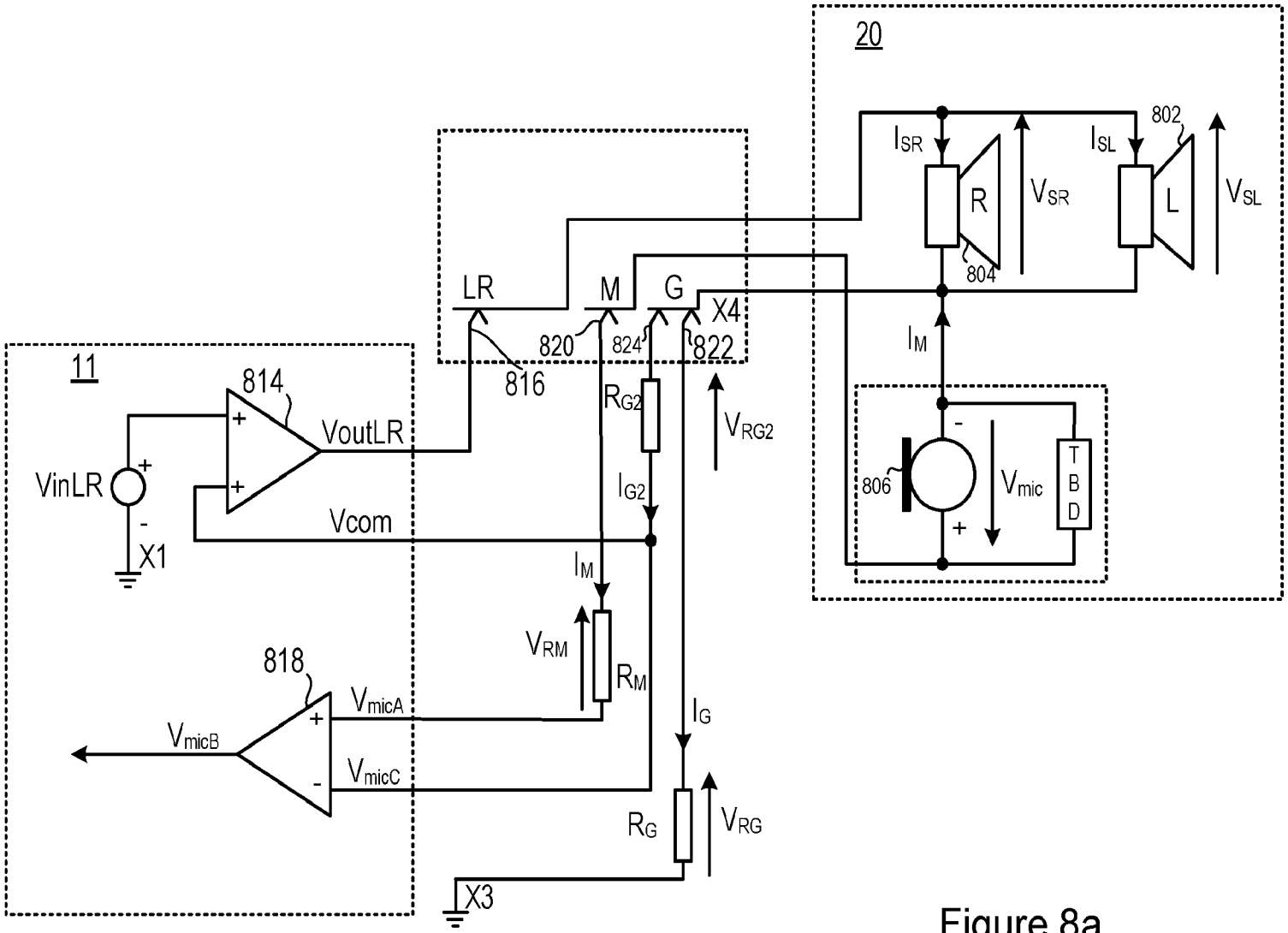
FIG. 8*a* is a circuit diagram of a further alternative audio system as shown in FIG. 3.

FIG. 8*a* is an electrical circuit diagram of a further alternative system of the general type shown in FIG. 3. Specifically, FIG. 8*a* shows the headset 20 as being a mono headset, having a left speaker 802 and a right speaker 804 connected in parallel, and also having a microphone 806.

Figure 8B:
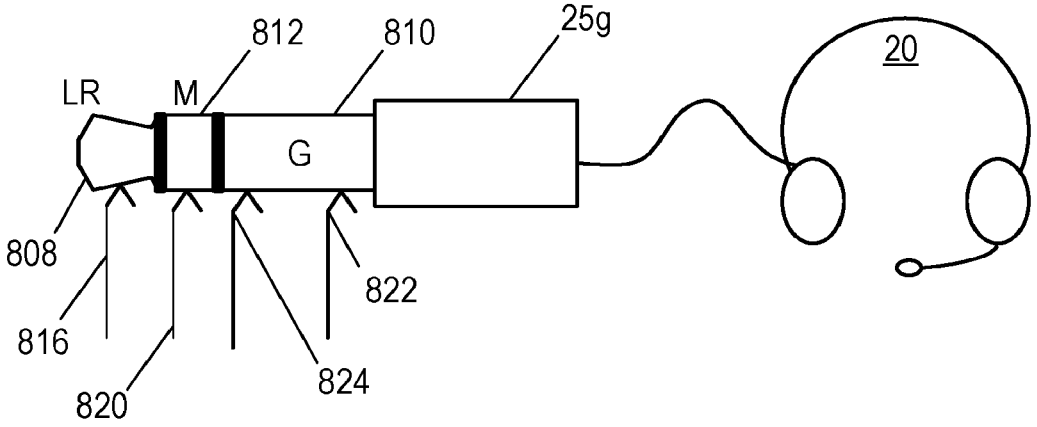
FIGS. 8*b* and 8*c* illustrate embodiments of a plug and socket in the audio system of FIG. 8*a*.

As shown in FIG. 8*b* in conjunction with FIG. 8*a* the headset 20 is provided with a jack plug 25*g*, which in this example is a TRS plug. The left speaker 802 is connected between the tip (T) 808 and the sleeve (S) 810 of the plug 25*g*. The right speaker 804 is similarly connected between the tip (T) 808 and the sleeve (S) 810 of the plug 25*g*, so that the two speakers receive the same driving signal. The microphone 806 is connected between the ring (R) 812 and the sleeve (S) 810 of the plug 25*g*. Thus, the sleeve 810 acts as a common ground return.

The tip 808, ring 812, and sleeve 810 of this plug may thus be regarded as the LR, M and G poles respectively of the jack plug 25*g*.

In the circuitry 11, a single driver amplifier 814 is driven from a signal source VinLR which may comprise a DAC and produces a buffered output signal VoutLR. An output of driver amplifier 814 is coupled to the jack socket contact 816.

FIG. 8*a* also shows an amplifier 818 serving as a microphone pre-amplifier with an input coupled to a jack socket contact 820.

A further, i.e. a fourth, jack socket contact 822 provides the common ground return path for the signal paths through the jack socket contacts 816 and 820.

Thus, when the jack plug is inserted into the jack socket, the tip contact 808 of the plug 25*g* contacts the jack socket contact 816; the ring contact 812 of the plug 25*g* contacts the jack socket contact 820; and the sleeve contact 810 of the plug 25*g* contacts the jack socket contact 822.

As shown in FIG. 8*a*, the jack socket is provided with an additional jack socket contact 824. The additional jack socket contact 824 is positioned in the socket such that, when the plug 25*g* is inserted into the socket, the sleeve contact 810 of the plug 25 contacts the additional jack socket contact 824 as well as the jack socket contact 822.

The additional jack socket contact 824 is connected to a second input of the microphone amplifier 818. Thus, the amplifier 818 is designed to produce an output $V_{micB}$ that depends on the difference between its two inputs $V_{micA}$ and $V_{micC}$.

The additional jack socket contact 824 is also connected to a second input of the driver amplifier 814. The voltage on this second input is Vcom. Preferably, amplifier 814 is designed to produce an output VoutLR which depends on the sum of VinLR and Vcom.

FIG. 8*a* illustrates the various parasitic resistances in the ground path between the jack pole G and a ground reference point X3 close to the circuitry 11, lumped into a single resistance element $R_G$.

There may also be similar parasitic resistances between the jack plug pole M and the microphone pre-amplifier 818, and FIG. 8*a* shows these lumped into a single resistance element $R_M$.

The parasitic resistances associated with the additional jack socket contact 824 are shown in FIG. 8*a* as the resistance element $R_{G2}$.

It can be assumed that the second, i.e. reference, input of the driver amplifier 814 connected to Vcom, and the inputs of the microphone amplifier 818 connected to $V_{micA}$ and $V_{micC}$ are high impedance inputs. Hence, there will be negligible currents $I_M$ and $I_{G2}$ flowing in the respective parasitic resistances $R_M$ and $R_{G2}$ associated with the tracks to these inputs, and thus the voltage drops $V_{RM}$ and $V_{RG2}$ will also be negligible.

The current $I_G$ through the ground pole G of the jack plug comprises both the currents $I_{SL}$ and $I_{SR}$ through the left and right speakers 802, 804 and also any current $I_M$ through the M pole of the plug that might return via pole G:

$$I_G=I_{SL}+I_{SR}+I_M.$$

Given that any current flowing through contact 824 may be negligible compared with that flowing through contact 822, the whole of $I_G$ will flow through parasitic resistance $R_G$, and so the ground voltage on the pole of the jack, at node X4, will differ from that at X3 by a voltage $V_{RG}$, where:

$$V_{RG}=I_G*R_G.$$

The voltage actually appearing across each speaker 802, 804 will be the voltage generated by the driver amplifier 814, reduced by $V_{RG}$. That is:

$$V_{SL}=V_{SR}=V\text{out}LR-V_{RG}.$$

As mentioned above, amplifier 814 is configured such that VoutLR=VinLR+Vcom.

Moreover, as $V_{RG2}$ is negligible, Vcom=$V_{RG}$.

Thus:

$$V_{SL}=V_{SR}=V\text{out}LR-V_{RG}=(V\text{in}LR+V\text{com})-V_{RG}=(V\text{in}LR+V_{RG})-V_{RG}=V\text{in}LR$$

Thus, $V_{SL}$=VinLR and $V_{SR}$=VinLR, and any microphone signal cannot cause crosstalk at the speakers 802, 804.

As also mentioned above:

$$V_{micB}=V_{micA}-V_{mic}$$

Considering the voltages shown in FIG. 8*a:*

$$V_{micA}=V_{mic}+V_{RG}-V_{RM} \text{ and}$$

$$V_{micC}=V_{RG}-V_{RG2}$$

However, as mentioned above, $V_{RM}$ and $V_{RG2}$ are negligible, and so:

$$V_{micB}=V_{micA}-V_{mic}=(V_{mic}+V_{RG})-V_{RG}=V_{mic}.$$

Thus the net voltage appearing at the output of the preamplifier 818 is equal to $V_{mic}$ (probably with a voltage gain applied by the preamplifier).

Any other interference appearing at the jack pole, i.e. any other additional component of $V_{RG}$ superimposed on $I_G \cdot R_G$, due for instance to rectified EMI (electromagnetic interference) will also be removed from the net speaker drive and microphone sense signals.

Figure 8C:
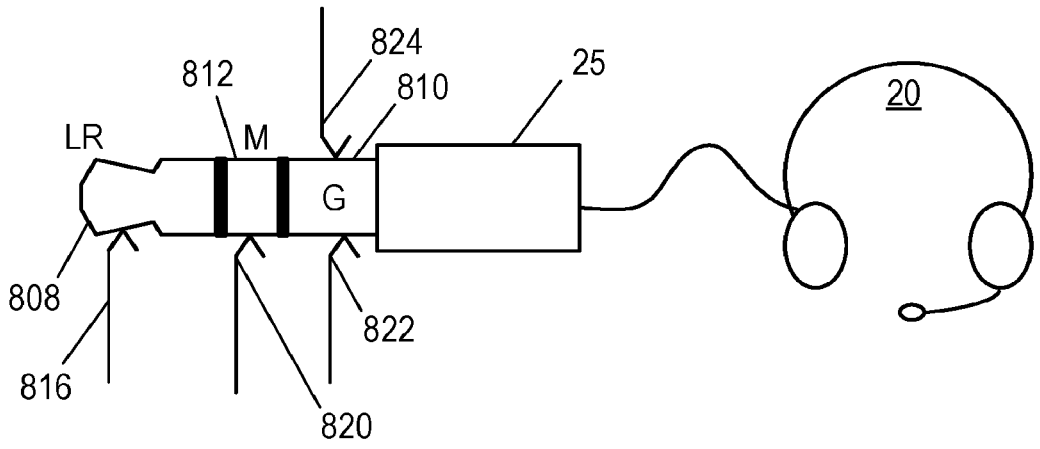

The additional jack socket contact 824 may be implemented mechanically in various forms depending on the application. FIG. 8*c* illustrates a construction where the additional contact 824 is located on the opposite side of the jack plug from the contact 822, and FIG. 8*b* illustrates a construction where the additional contact 824 is substantially on the same side of the jack plug as the contact 822, and displaced further along the plug in a direction parallel with the axis of the plug.

FIG. 8*a* illustrates an example where the speakers 802, 804 are connected in parallel. However, exactly the same circuitry 11 can be provided in the case where the speakers 802, 804 are connected in series, or in the case where there is only one speaker.

It will also be noted that, while FIG. 8*a* shows the second input of the driver amplifier 814 being connected to the additional contact 824, in examples where the speaker drive gain accuracy or microphone-to-speaker crosstalk is not considered important, the second input of the driver amplifier 814 need not be connected to the additional contact 824 and may instead be connected to a ground closely coupled to ground reference point X3.

Embodiments described so far relate to a device having a socket that is configured to receive a cylindrical plug. However, other connectors may be used. Thus, in further embodiments, the mechanical configuration of the plug may be different from the cylindrical plug with poles distributed along a common axis described hitherto. Various mechanical configurations are possible for a socket to still provide a plurality of contacts to mate with a signal pole of an inserted plug. For instance a receptacle for a USB Type C plug may comprise two separate contacts in the area normally occupied by a single contact, or in an area facing a contact of an inserted USB Type C plug. The USB Type C plug may be wired to an adapter or captive accessory according to the USB Type C Audio Adapter Accessory Mode. Preferably the multi-pole contact is on one or both terminals assigned to MIC/GND (M/G) or GND/MIC (G/M) in this mode.

In embodiments above, the accessory has been illustrated as comprising a plug or male connector, inserted into a socket or female connector on the device. In further embodiments, the device may comprise a male connector and the accessory a female connector. In some embodiments the connectors may be sex-less, for example each being a coplanar array of contact pads or suchlike, mechanically held together by means such as magnetic elements.

The terms host device and accessory device have been used to denote respectively a first device containing circuitry 11 connected to a second device containing some acoustic load or transducer connected together by some detachable connector means.

In some cases the first device containing the circuitry 11 may be more naturally be considered an accessory and the second device containing some acoustic load or transducer may be considered a host device.

Switches coupled to the M and G poles have been illustrated as single-pole double-throw switches, where the pole of the switch may be connected to one of two other terminals. These may be implemented as a pair of elements, for example MOS transistor switches, connected between the common switch pole to respective other terminals, with one of the two switches being in a conductive state and the other in a non-conductive state at any one time. However in some embodiments the switches may be controlled so that at some times both switches may be on at the same time or neither of the two switches is on at the same time.

Figure 9A:
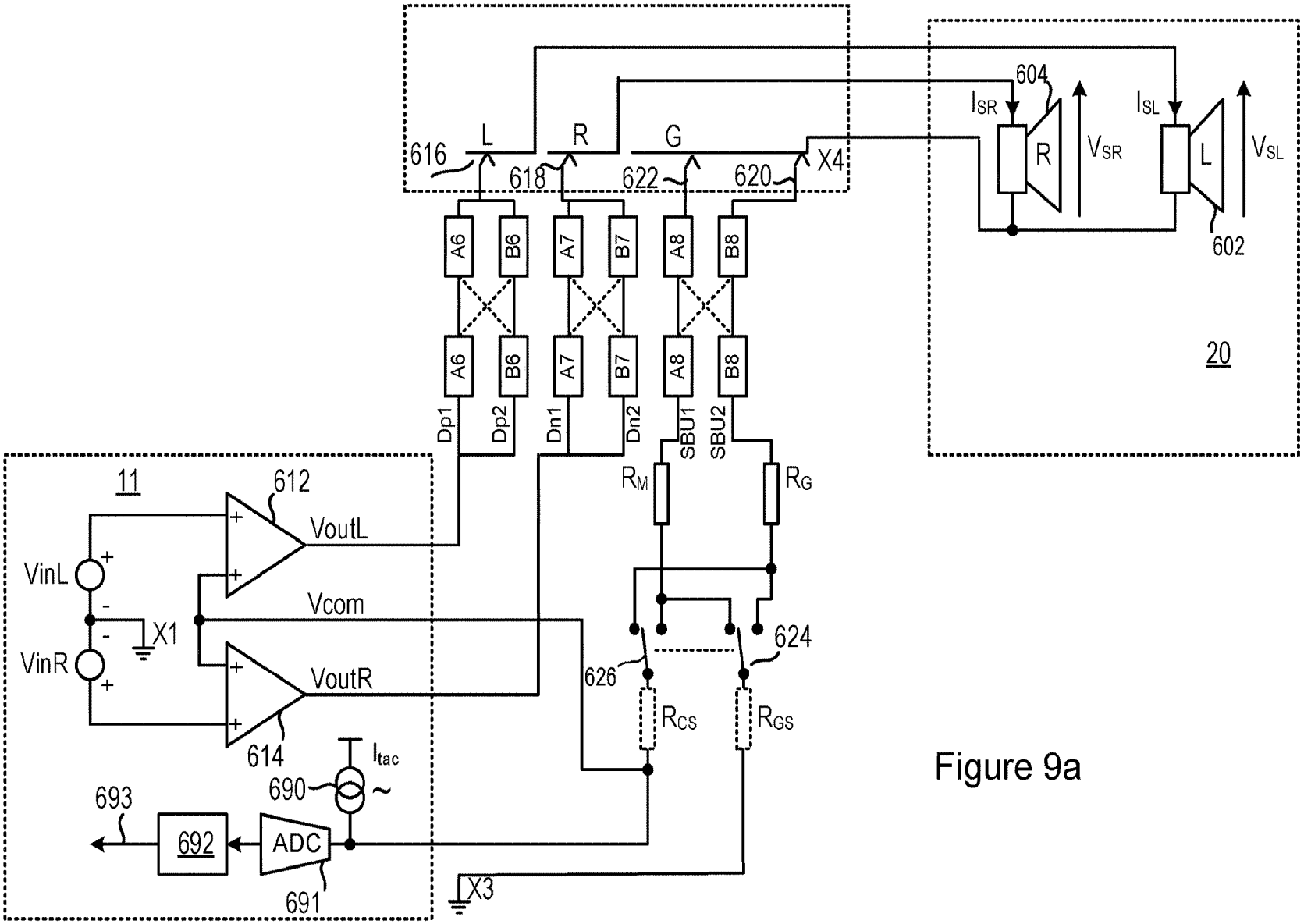
FIG. 9*a* is a circuit diagram of a further alternative audio system as shown in FIG. 3.
Figure 9B:
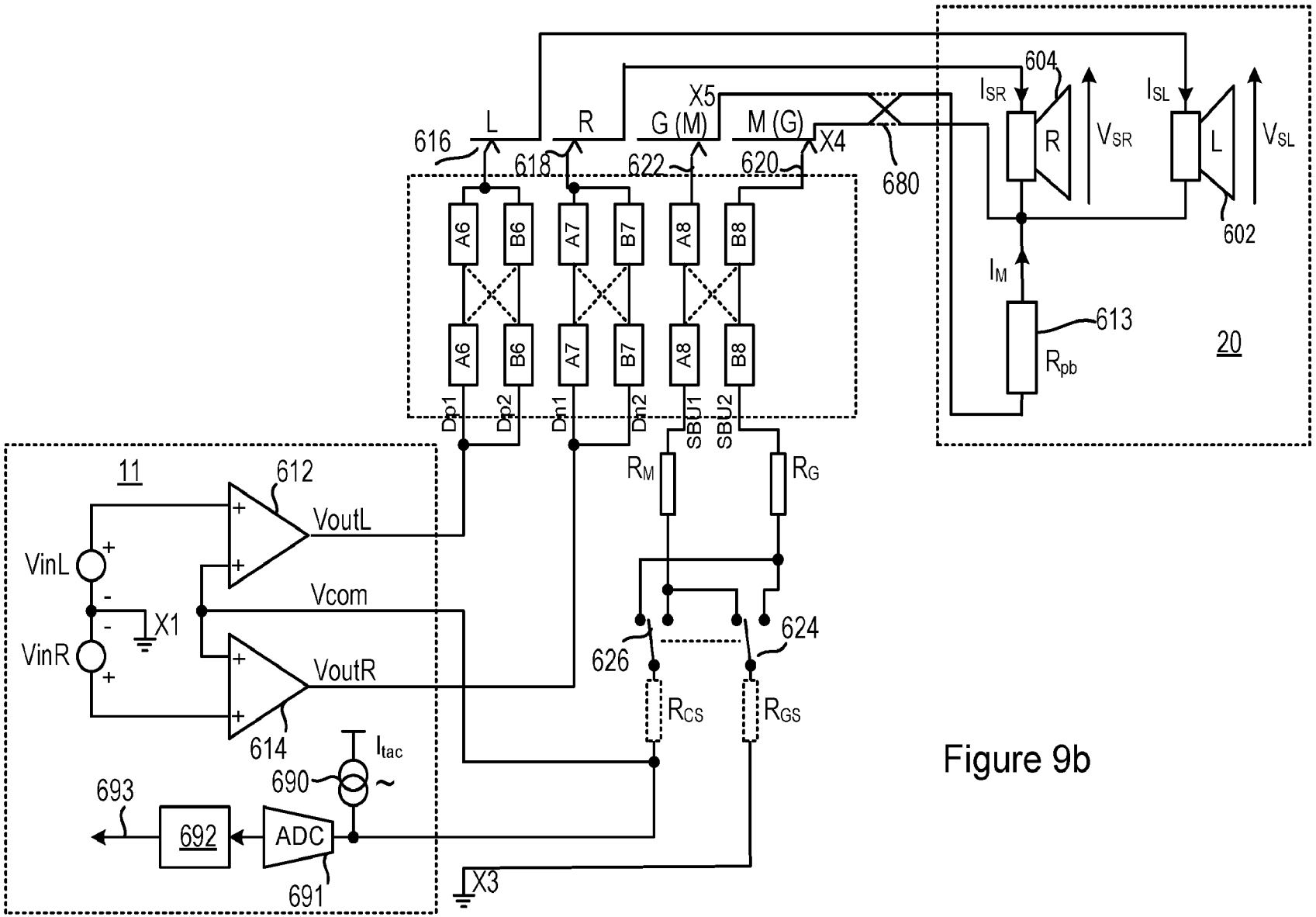
FIG. 9*b* is a circuit diagram of a further alternative audio system as shown in FIG. 3.

FIG. 9*a* and FIG. 9*b* illustrate further embodiments. These illustrate embodiments similar to FIGS. 6*a* and 6*e* respectively, with like numbered elements denoting equivalent components, but in this case the device may incorporate a different receptacle and plug arrangement, such as a USB Type C arrangement, interposed between the switches and amplifiers and the socket contacts. The accessory plug may be inserted into a 3.5 mm audio jack-to-USB adapter comprising a four pole jack socket and a 24-pin USB-C plug wired according to the USB Type C Audio Adapter Accessory Mode annex, which is incorporated herein by reference, of which the six most relevant contacts are shown. This plug may be attached in either rotational polarity to a 24-pin USB Type C receptacle, wired to couple to circuitry 11 as shown. In this case the combination of the host device and the adapter may be considered as a device coupled to the accessory. It will be appreciated by those skilled in the art that while a 24-pin USB Type C arrangement has many more contacts than a traditional 3 or 4 pole audio socket and plug arrangement that are allocated to other non-audio functionality, and therefore more capability and/or flexibility, the USB-C contacts other than those associated with audio accessory functionality have been ignored for reasons of clarity.

In each case the operation associated with FIGS. 9*a* and 9*b* is similar to that described with respect to FIGS. 6*a* and 6*e* respectively. For analysis, any relevant parasitic resistances associated with the USB socket connections or any cabling between the sockets and the circuitry 11 may be lumped together with $R_G$ or $R_M$ and crosstalk due to all components of these resistances may be shown to be reduced by similar analysis to that of FIGS. 6*a* and 6*e*.

Note that as used herein the term module shall be used to refer to a functional unit or block which may be implemented at least partly by dedicated hardware components such as custom defined circuitry and/or at least partly be implemented by one or more software processors or appropriate code running on a suitable general purpose processor or the like. A module may itself comprise other modules or functional units. A module may be provided by multiple components or sub-modules which need not be co-located and could be provided on different integrated circuits and/or running on different processors.

Embodiments may be implemented in a host device, especially a portable and/or battery powered host device such as a mobile telephone, an audio player, a video player, a PDA, a mobile computing platform such as a laptop computer or tablet and/or a games device for example. Embodiments of the invention may also be implemented wholly or partially in accessories attachable to a host device, for example in active speakers or headsets or the like. Especially in more complex devices, there may be more than one connector and associated signal paths per aspects of the invention.

It should be noted that the above-mentioned embodiments illustrate rather than limit the invention, and that those skilled in the art will be able to design many alternative embodiments without departing from the scope of the appended claims. The word "comprising" does not exclude the presence of elements or steps other than those listed in a claim, "a" or "an" does not exclude a plurality, and a single feature or other unit may fulfil the functions of several units recited in the claims. Any reference numerals or labels in the claims shall not be construed so as to limit their scope. Terms such as amplify or gain include possibly applying a scaling factor of less than unity to a signal.

The invention claimed is:

1. A device for connection to an audio accessory comprising:

(a) a jack socket for connection to a jack plug of the audio accessory, (b) a ground connection to a first socket contact which is positioned to mate with a ground return pole of the plug when inserted, and (c) a pair of driver amplifiers each for driving a respective speaker signal onto a respective other pair of contacts of the socket, wherein:

said jack socket comprises a second contact also positioned to mate with the ground return pole of the plug, and each of said driver amplifiers comprises an input coupled to said second contact and is configured to superimpose a signal present at the second contact onto said respective speaker signal.

2. A device as claimed in claim 1 wherein said first and second contacts are positioned to both mate with the same pole of a 3-pole jack plug.

3. A device as claimed in claim 2 wherein said first and second contacts are positioned to both mate with the sleeve of a 3-pole jack plug.

4. A device as claimed in claim 1 wherein said first and second contacts are positioned to both mate with the same pole of a 4-pole jack plug.

5. A device as claimed in claim 1, wherein the device is a computing device and/or a portable communications device.

6. A device as claimed in claim 5, wherein the device is a tablet computer.

7. A device as claimed in claim 5, wherein the device is a mobile phone.

8. A device for connection to an audio accessory comprising:

a) a jack socket for connection to a jack plug of the audio accessory, b) a ground connection to a first socket contact which is positioned to mate with a first, ground return, pole of the plug when inserted, and c) a driver amplifier for driving a speaker signal onto a further contact of the socket, wherein:

said jack socket comprises a second contact also positioned to mate with the ground return pole of the plug, said driver amplifier comprises a first input coupled to said second contact and is configured to superimpose a signal present at the second contact onto said speaker signal.

9. A device as claimed in claim 8, wherein the further contact of the socket is positioned to mate with a second pole of the jack plug.

10. A device as claimed in claim 8, wherein the driver amplifier further comprises:

a second input, wherein said second input is coupled to receive a driver signal, and wherein:

the driver amplifier is configured to superimpose a signal received at the first input thereof onto the driver signal, and to output the result to the further contact of the jack socket.

11. A device as claimed in claim 8, further comprising a second amplifier, wherein the second amplifier comprises:

(i) a first input coupled to said second contact of the jack socket, and (ii) a second input coupled to a third contact of the jack socket which is positioned to mate with a third pole of the jack plug, wherein the second amplifier is configured to output a signal based on the difference between a signal received at the second input thereof and a signal received at the first input thereof.

12. A device as claimed in claim 8, wherein the first contact and the second contact are positioned to contact the first pole of the jack plug on opposite sides of the jack socket.

13. A device as claimed in claim 8, wherein the first contact and the second contact are positioned to contact the first pole of the jack plug on the same side of the jack socket, laterally displaced from one another.

14. A device as claimed in claim 8, wherein the device is a computing device and/or a portable communications device.

15. A device as claimed in claim 14, wherein the device is a tablet computer.

16. A device as claimed in claim 14, wherein the device is a mobile phone.

17. A device for connection to an audio accessory comprising:

a jack socket for connection to a jack plug of the audio accessory, and a ground connection to a first socket contact which is positioned to mate with a ground return pole of the plug when inserted, wherein said jack socket comprises a second socket contact also positioned to mate with the ground return pole of the plug, wherein the device further comprises a microphone pre-amplifier with a first input coupled to a third socket contact of the socket and a second input coupled to the second socket contact of the socket, and wherein said microphone pre-amplifier is configured to output a signal based on the difference between the voltages on said third socket contact and said second socket contact.

18. A device as claimed in claim 17, wherein the third socket contact is positioned to mate with a second pole of the plug when inserted.

19. A device as claimed in claim 17, further comprising at least one driver amplifier, wherein the at least one driver amplifier has respective first and second inputs, with the or each first input connected to receive a respective speaker signal, and with the or each second input connected to said second socket contact, and wherein an output of the at least one driver amplifier is connected to a respective fourth socket contact, and wherein the or each fourth socket contact is positioned to mate with a respective third pole of the plug when inserted.

20. A device as claimed in claim 17, wherein the device is a computing device and/or a portable communications device.

* * * * *